United States Patent [19]

Walker

[11] Patent Number: 4,890,344

[45] **Date of Patent: * Jan. 2, 1990**

[54] AIR CONTROL SYSTEM FOR AIR BED

[76] Inventor: Robert A. Walker, 8939 Vinewood Lane North, Maple Grove, Minn. 55369

[ * ] Notice: The portion of the term of this patent subsequent to May 16, 2006 has been disclaimed.

[21] Appl. No.: 304,172

[22] Filed: Jan. 31, 1989

Related U.S. Application Data

[60] Division of Ser. No. 96,932, Sep. 14, 1987, Pat. No. 4,829,616, which is a continuation-in-part of Ser. No. 791,397, Oct. 25, 1985, abandoned, which is a continuation-in-part of Ser. No. 455,664, Jan. 5, 1983, abandoned.

[51] Int. Cl.[4] ..... A47C 27/08

[52] U.S. Cl. ..... 5/453; 200/83 Q; 297/DIG. 3; 297/330; 251/123.05; 5/443; 5/455; 5/469

[58] Field of Search ..... 5/453–455, 5/61, 449, 68, 81 R, 88, 468; 417/413, 417, 418, 316, 317; 137/596, 565, 625.25, 625.27, 625.68; 200/83 Q; 297/DIG. 3, 111, 330; 251/129.05, 129.09, 129.10

[56] References Cited

U.S. PATENT DOCUMENTS

| | | | |
|---|---|---|---|
| 388,037 | 8/1888 | Hargin . | |
| 795,108 | 7/1905 | Doellinger . | |
| 2,000,873 | 5/1935 | Arens | 5/348 |
| 2,136,510 | 11/1938 | Jensen | 277/26 |
| 2,245,909 | 6/1941 | Enfiajian | 5/348 |
| 2,274,338 | 2/1942 | Cody | 417/317 |
| 2,734,678 | 2/1956 | Edwards | 417/317 |
| 2,769,182 | 11/1956 | Nunlist | 5/68 |
| 2,785,638 | 3/1957 | Moller | 417/505 |
| 2,930,324 | 3/1960 | Toulmin, Jr. | 103/53 |
| 2,998,817 | 9/1961 | Armstrong | 128/33 |
| 3,068,494 | 12/1962 | Pinkwater | 5/348 |
| 3,148,391 | 9/1964 | Whitney | 5/348 |
| 3,162,134 | 12/1964 | Lovell | 417/317 |
| 3,303,518 | 2/1967 | Ingram | 5/349 |
| 3,326,601 | 6/1967 | Vanderbilt et al. | 297/284 |
| 3,394,415 | 7/1968 | Parker | 5/348 |
| 3,426,373 | 2/1969 | Scott et al. | 5/348 |
| 3,462,778 | 8/1969 | Whitney | 5/347 |
| 3,468,278 | 9/1969 | Kercheval | 417/505 |
| 3,494,290 | 2/1970 | Schaible | 417/505 |
| 3,558,239 | 1/1971 | Schiber | 417/505 |
| 3,587,568 | 6/1971 | Thomas | 128/33 |
| 3,605,138 | 9/1971 | Tucker | 5/90 |
| 3,623,485 | 11/1971 | Bowen | 128/402 |
| 3,701,173 | 10/1972 | Whitney | 5/349 |
| 3,724,485 | 4/1973 | Cox et al. | 137/117 |
| 3,775,781 | 12/1973 | Bruno et al. | 5/61 |
| 3,784,994 | 1/1974 | Kery | 5/348 |

(List continued on next page.)

FOREIGN PATENT DOCUMENTS

| | | | |
|---|---|---|---|
| 2107371 | 9/1971 | Fed. Rep. of Germany | 417/505 |
| 3205853 | 10/1982 | Fed. Rep. of Germany | 297/284 |
| 3133589 | 3/1983 | Fed. Rep. of Germany | 417/317 |

*Primary Examiner*—Vinh T. Luong

*Attorney, Agent, or Firm*—Burd, Bartz & Gutenkauf

[57] ABSTRACT

An air supply and control apparatus has an air pump to supply air under pressure to air mattresses of an air bed. A hand control having a pair of valves functions to control the operation of the air pump to supply air to the air mattresses and vent air from the air mattresses. A second embodiment of the air supply and control apparatus has a motor driven impeller for supplying air under pressure to air mattresses. Solenoids having two coils operate valves to allow air to flow to the air mattress or vent air from the air mattress to adjust the firmness of the mattress. A normally closed switch is opened when the solenoid opens the valve. The switch turns off one coil of the solenoid. The other coil remains energized to hold the valve open. Hand controls having switches are electrically coupled to the motor and solenoids to control the operation thereof. A third embodiment of the air control apparatus has air pump and valve assembly operable with a hand control to selectively direct air under pressure to an air mattress and vent air from the air mattress. The air mattress and air control apparatus is incorporated into a sofa bed.

11 Claims, 12 Drawing Sheets

U.S. PATENT DOCUMENTS

| | | | |
|---|---|---|---|
| 3,822,425 | 7/1974 | Scales | 5/348 |
| 3,867,732 | 2/1975 | Morrell | 5/349 |
| 3,868,103 | 2/1975 | Pageot et al. | 137/596 |
| 4,065,230 | 12/1977 | Gezari | 417/317 |
| 4,074,373 | 2/1978 | Garofalo | 5/511 |
| 4,083,346 | 4/1978 | Eheim | 417/505 |
| 4,139,020 | 2/1979 | Sebo | 137/596 |
| 4,150,922 | 4/1979 | Cuenoud et al. | 417/505 |
| 4,175,297 | 11/1979 | Robbins et al. | 5/284 |
| 4,190,286 | 2/1980 | Bentley | 297/284 |
| 4,224,706 | 9/1980 | Young et al. | 5/449 |
| 4,225,989 | 10/1980 | Corbett et al. | 5/453 |
| 4,306,322 | 12/1981 | Young et al. | 5/449 |
| 4,309,153 | 1/1982 | Panick et al. | 417/413 |
| 4,394,784 | 6/1983 | Swenson et al. | 5/453 |
| 4,491,157 | 1/1985 | Hashimoto | 137/871 |
| 4,504,198 | 3/1985 | Toyoda et al. | 417/505 |
| 4,570,676 | 2/1986 | Nishio et al. | 137/870 |
| 4,583,255 | 4/1986 | Mogaki et al. | 5/453 |
| 4,616,676 | 10/1986 | Adams et al. | 137/636.4 |
| 4,644,597 | 2/1987 | Walker | 5/449 |
| 4,647,003 | 3/1987 | Hilpert et al. | 251/14 |
| 4,647,009 | 3/1987 | Idogaki et al. | 251/129.05 |
| 4,653,130 | 3/1987 | Senoue et al. | 5/453 |
| 4,766,628 | 8/1988 | Walker | 5/449 |

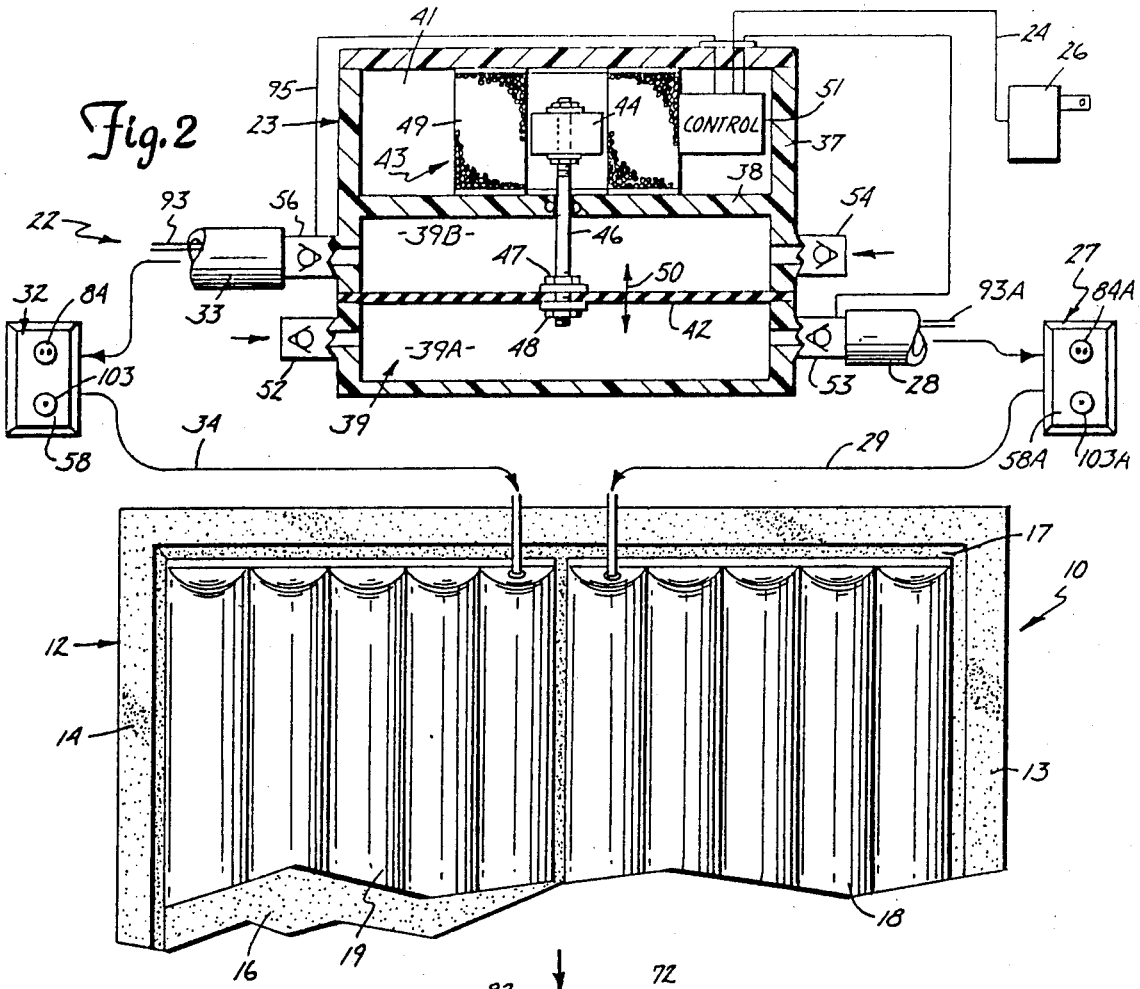
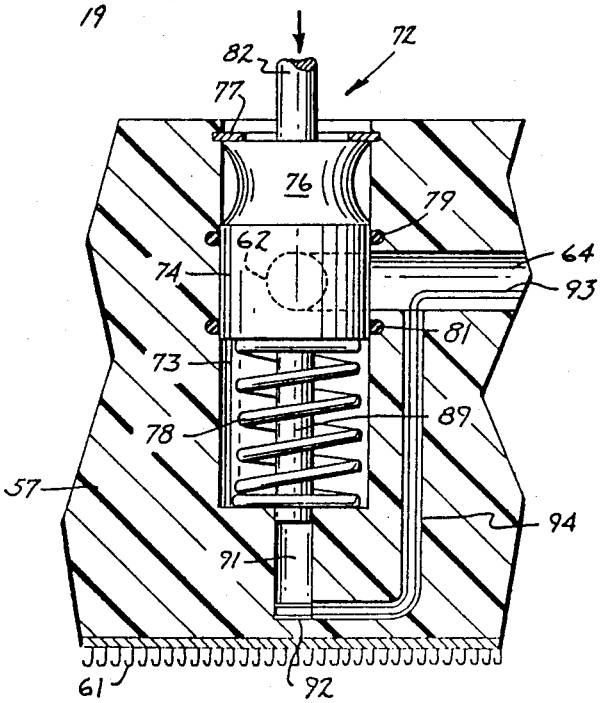
Fig. 7

AIR CONTROL SYSTEM FOR AIR BED

CROSS REFERENCE TO RELATED APPLICATION

This is a division of application Ser. No. 96,932 filed September 14, 1987 now U.S. Pat. No. 4,829,616 issued on May 16, 1989, which application is a continuation-in-part of U.S. application Ser. No. 791,397 filed October 25, 1985. Application Ser. No. 791,397 is a continuation-in-part of application Ser. No. 455,664 filed January 5, 1983, now abandoned. Application Ser. No. 859,866 filed May 2, 1986, pending, is a continuation of U.S. application Ser. No. 455,664.

TECHNICAL FIELD

The invention relates to fluid pumps and controls having valves and switches associated with the pumps for regulating fluid pressure in one or more fluid accommodating structures. More particularly, the invention is directed to air pumps and hand controls for supplying air under pressure to air mattresses and adjusting the pressure of the air in the air mattresses.

BACKGROUND OF THE INVENTION

Air mattresses are used with cots and beds to provide yieldable body supports. The air mattresses are inflated with pumps, such as hand operated pumps and bag pumps. Motor driven blowers and pumps have also been used to supply air under pressure to air mattresses. The biasing or firmness characteristics of an air mattress is determined by the pressure of the air in the air mattress. The air mattress firmness can be varied by supplying additional air or venting air from the air mattress. Control mechanisms have been used to adjust the inflation of air mattresses. Young et al in U.S. Pat. No. 4,244,706 discloses a mechanism for adjusting the amount of air in an air mattress. The mechanism includes bladders connected to air mattresses for supplying air to and receiving air from the air mattresses. The internal volumes of the bladders are changed to adjust the pressure of the air in the air mattresses. Other control mechanisms operable to adjust the inflation of air mattresses are disclosed in U.S. Pat. Nos. 3,605,138; 3,784,944; 3,822,425; and 4,394,784.

SUMMARY OF THE INVENTION

The invention is an apparatus for supplying fluid, such as air, under pressure to fluid accommodating means and automatically adjusting the fluid pressure in the fluid accommodating means. Pump means operated with an electric powered means provides a supply of fluid under pressure. A control means connects the electric powered means to a source of electric power to operate the pump means, and receives the fluid from the pump means and directs the fluid to the fluid accommodating means. The control means includes valve means operable to vent fluid from the fluid accommodating means.

According to the invention, there is provided an apparatus for supplying air under pressure to one or more air mattresses used as a body support in an air bed. The apparatus comprises an air pump having a movable member. An electric powered means connected to the movable member operates to move the member thereby pump air. The electric powered means and movable member can be an electric motor that rotates an impeller to provide a supply of air under pressure for the air mattress. The air is carried in air line means to control means. A second air line means connects the control means to the air mattress. The control means has normally closed first valve and a normally open switch connecting a source of power to the electric powered means when the switch is closed. The first valve when moved to the open position connects the pump means to the air mattress and closes the switch whereby the pump means operates to pump air under pressure through the first valve into the air mattress. The pump means continues to dispense air as long as the switch is closed. When the first valve is returned to its closed position, the switch is opened thereby cutting off the electric power to the electric powered means and stopping the pump means. The closed first valve blocks the flow of air out of the air mattress. The control means has a normally closed second valve blocking a passage open to atmosphere. When the second valve is moved to its open position, air from the air mattress is vented to atmosphere thereby reducing the firmness of the air mattress.

The control means are hand operated units that are used with air beds to regulate inflation of each air mattress in the air bed. Each unit is manually operated to control the air pump and regulate the air supply of one air mattress. The firmness of each air mattress of the air bed can be independently adjusted to satisfy the comfort desires of the user. Each unit is provided with flexible hook elements operable to releasably mount the control means on a fabric or like support.

A first modification of the air control apparatus for providing air under pressure to one or more air mattresses has an air pump blower comprising an electric motor driven impeller. A pair of solenoid operated valves operate to allow air under pressure to be delivered to the air mattresses and permit the venting of air from the air mattresses. Hand control switches are operable to control the operation of the solenoids. The switches also control the operation of the electric motor that rotates the impeller to provide the air under pressure. Conventional AC powered solenoids generate heat and make a buzzing noise when energized. These solenoids must be allowed to cool when used for a period of time to avoid burning out. The solenoids of the invention have a first coil for DC power to open the valve and a second coil for holding the valve in position. Both coils are turned in the same direction to establish a common magnetic field that moves a plunger connected to the valve. The first coil is connected to a normally closed switch which is opened in response to the energization of the solenoid. The first and second coils are connected to a resistance bridge rectifier that converts the AC power to DC power. The use of the DC power on the coils to open the valve and allow one energized coil to hold the valve in an open position eliminates noise problems and avoids burning out of the solenoids. This increases the life of the solenoid and minimizes servicing and repair thereof. The hand control has an actuator that is movable to a first or firm position wherein the solenoid for one of the valves is open and the motor for the impeller is operated. The rotating impeller moves air into the air mattress through the open valve. The switch actuator can be moved to a second or soft position wherein the solenoid is energized but the motor is not energized. The air in the mattress is free to vent to the atmosphere.

A second modification of the air control apparatus has an air controller comprising an air pump and valve apparatus moving air into an air mattress to inflate the mattress and alternatively withdraw air from the air mattress to deflate the mattress. The pump includes an electric motor driven impeller. A first valve is a solenoid operated valve that operates to allow air to be pumped into and out of the air mattress. A second valve includes a solenoid operated gate provided with a plurality of openings to control the direction of the flow of air through the control apparatus. A hand control switch is operable to control the operation of the solenoids. The switch also controls the operation of the electric motor that rotates the impeller for pumping air to and from the air mattress. The first valve solenoid has a first coil for holding the valve in the open position and a second coil that operates with the first coil for DC power to open the valve. Both coils are turned in the same direction to establish a common magnetic field that moves a plunger connected to the first valve. The second coil is connected to a normally closed switch which is opened in response to the energization of the valve solenoid. The first and second coils are connected to a resistance bridge rectifier that converts AC power to DC power. The coils when energized with DC power cooperate to open the first valve. When the first valve is open it is held open by the continued energization of one of the coils. This eliminates noise problems and avoids burning out of the solenoid. The life of the solenoid is increased and the servicing thereof is reduced. A gate solenoid operates to move a spring arm connected to the gate to bias the gate to a position to allow air to be pumped into the air mattress when the first valve is open. The hand control has an actuator that is movable to a first or firm position wherein the first valve solenoid is energized to open the first valve and the motor for the impeller is operated. The rotating impeller moves air into the air mattress through the open first valve. The switch actuator can be moved to a second or vent position wherein the gate solenoid along with the first valve solenoid and the motor are energized. The gate solenoid moves the gate to a position to change the direction of air flow through the control apparatus. The rotating impeller moves air from the air mattress to the atmosphere thereby deflating the air mattress.

DESCRIPTION OF DRAWING

FIG. 2 is a diagrammatic view of the air control apparatus showing the air pump in section connected to a pair of air mattresses;

FIG. 7 is an enlarged sectional view taken along line 7—7 of FIG. 5;

DESCRIPTION OF PREFERRED EMBODIMENTS

Figure 1:
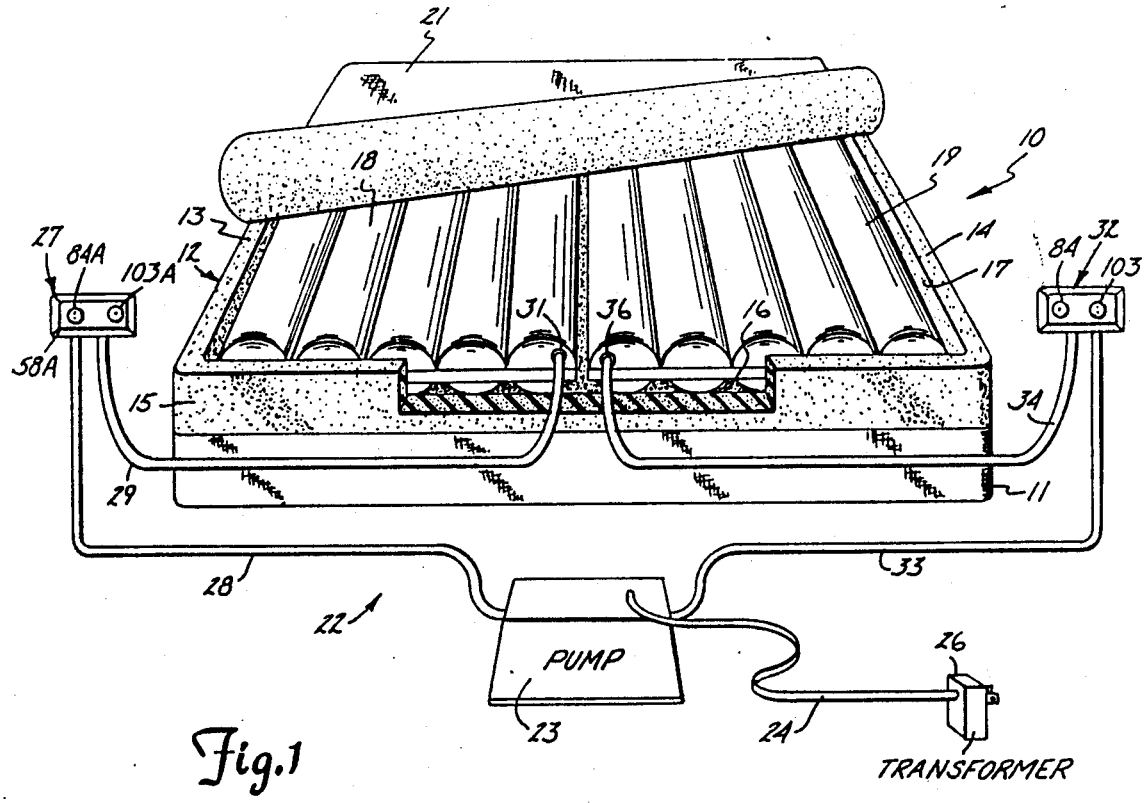
FIG. 1 is a perspective view of an air bed, partly in section, and an air control apparatus of the invention for the air mattresses of the air bed.

Referring to FIG. 1, there is shown a resilient support indicated generally at 10 having a generally horizontal surface for supporting an object. Support 10 is preferably an air bed to accommodate one or more persons. Support 10 has a generally rectangular base or box spring unit 11 adapted to be supported on a floor or a frame engaging the floor. A mattress unit indicated generally at 12 is located on top of box spring unit 11. Mattress unit 12 has a generally pan-shaped resilient member having upright linear side edges 13 and 14 joined to a transverse front edge 15. A similar transverse edge joins the rear or foot end of side edges 13 and 14. Edges 13 and 15 are integral with the peripheral portions of the generally flat bottom 16 and form therewith a generally rectangular chamber 17. A pair of side-by-side longitudinal air bladders 18 and 19 are located in chamber 17. The air bladders 18 and 19 are conventional air mattresses or air bags having a plurality of longitudinal chambers adapted to accommodate air under pressure. The air bladders 18 and 19 are of a size to fill chamber 17 with the outside of air bladder 18 located adjacent the inside of the side edge 13. The outside of air bladder 19 is located adjacent the inside surface of edge 14. Opposite ends of the air bladders 18 and 19 are located adjacent the front and rear edges so that the air bladders 18 and 19 fill chamber 17 when they are inflated. The air bladders are made of fabric bonded to vinyl sheet material. Bladders 18 and 19 may have X or I beam construction. The air bladders vary in size from 23 to 76 inches (58 to 194 cm) wide and 67 to 84 inches (170 to 213 cm) long. Preferably, the air bladders 18 and 19 have an inflated thickness of 5.5 inches (14 cm). Other types and sizes of air bladders can be used as air mattresses for air bed 10.

A generally rectangular cover 21 fits over edges 13 to 15 to enclose the top of chamber 17. Cover 21 rests on top of air bladders 18 and 19. As shown in FIG. 1, a portion of the cover 21 has been rolled back to illustrate the side-by-side relationship of air bladders 18 and 19 in chamber 17.

An air control indicated generally at 22 functions to provide air under pressure to bladders 18 and 19 and control the pressure of the air therein. Air control apparatus 22 has an air pump 23 operable to supply air under pressure to inflate bladders 18 and 19. An electrical line or cord 24 connects pump 23 to a transformer 26. Transformer 26 is adapted to be plugged into a conventional 110 AC electrical outlet receptacle to connect the pump 23 to a low voltage DC electrical current.

A first hand control 27 functions to regulate the air pressure in air bladder 18. A flexible tubular line or tube 28 connects the air outlet pump 23 to hand control 27. A second flexible line or tube 29 joins hand control 27 to an inlet connector 31 of air bladder 18. Lines 28 and 29 can be conveniently operated by a person lying on the air bed.

The pressure of the air in air bladder 19 is controlled with a second hand control 32. A first tubular line or tube 33 connects the air outlet of pump 23 with control 32. A second tubular line or tube 34 connects hand control 32 to a connector 36 of air bladder 19. Second hand control 32 functions independently of hand control 27 to regulate the pressure of air in air bladder 19. Hand controls 27 and 32 can be operated concurrently to control the air pressure in both bladders 18 and 19. Hand controls 27 and 32 can be mounted on side panels of the air bed. Referring to FIG. 2, pump 23 is a reciprocating diaphragm pump having a housing or casing 37 and a central generally horizontal wall 38. Wall 38 divides housing 37 into a pumping chamber 39 and a motor chamber 41. Pumping chamber 39 is separated into two chambers 39A and 39B with a generally flat flexible diaphragm 42. The outer peripheral edges of the diaphragm are clamped onto housing 37. A reciprocating electric motor or vibrator 43 is located in motor chamber 41. Motor 43 has a reciprocating core 44 connected to a rod 46. Rod 46 extends through the hole in wall 38 and is connected to the center portion of diaphragm 42 with a pair of nuts 47 and 48. A coil 49 surrounds core 44. The center of coil 49 has a cylindrical chamber accommodating core 44. An electronic control 51 located in chamber 41 is connected to coils 49 and the power supply line 24. Control 51 has switching circuits which change the direction of current flow in coil 49 thereby causing core 44 to reciprocate. The reciprocating core 44 causes diaphragm 42 to move up and down, as shown by the arrow 50. A reciprocating piston pump or motor driven blower can be used to supply air under pressure.

A one-way inlet valve 52 allows air to flow into the pumping chamber 39A when diaphragm 42 is moved in an upward direction. A one-way outlet valve 53 allows air to flow from chamber 39A into tubular member 28 when the diaphragm 42 moves in a downward direction. Valve 52 will close when valve 53 opens. A second one-way valve 54 mounted on housing 37 allows air to flow into pumping chamber 39B to flow into the tubular member 33 leading to the hand control 32. The reciprocating or up and down movement of diaphragm 42 functions to draw air into chambers 39A and 39B and pump the air out of chambers 39A and 39B into tubular members 28 and 33 leading to the hand controls 27 and 32.

Hand controls 27 and 32 are identical in structure and function. The following description is limited to hand control 32. As shown in FIGS. 3 to 7, hand control 32 has a body 57 of non-conductive plastic carrying a cap or cover 58.

The lower edge of body 57 has a peripheral outwardly directed lip 59 engaging the lower edge of the sides and ends of cover 58. The bottom of body 57 is flat. A generally rectangular pad or flexible hook elements 61 is attached to the flat bottom with a suitable adhesive. Screws or other types of fasteners can be used to attach pad 61 to body 57. Hook elements 61 releasably cling to fabrics, so that control 32 can be attached to sheets, blankets and quilts used on air beds.

Figure 6:
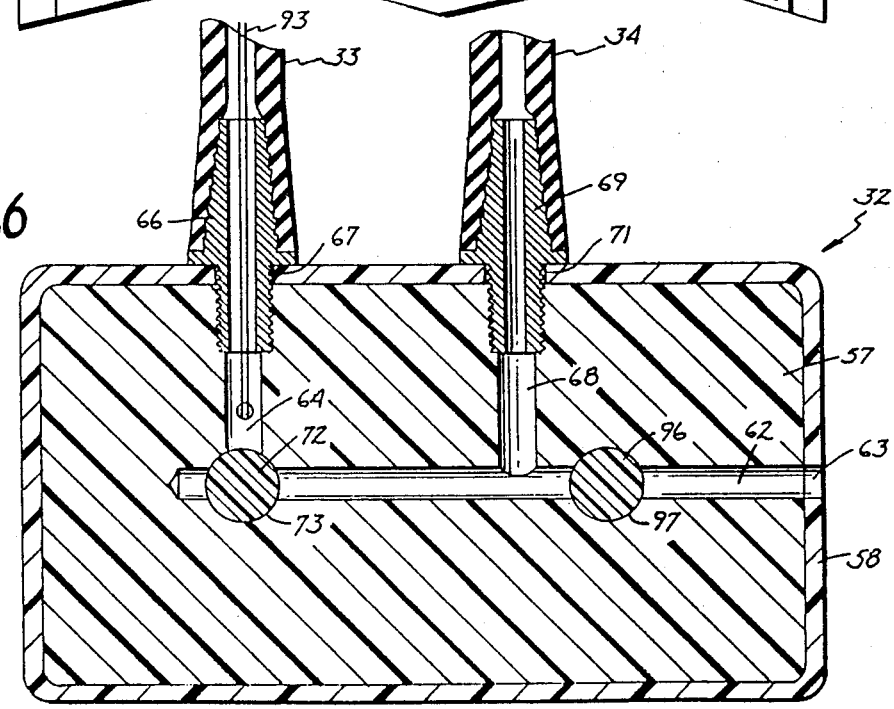
FIG. 6 is a sectional view taken along line 6—6 of FIG. 5.

As shown in FIG. 6, body 57 has a generally horizontal longitudinal main passage 62 aligned with a hole 63 in an end wall of cover 58. A first lateral passage 64 intersects the inner end of main passage 62. A nipple 66 having a passage extend through a hole 67 in the side wall of cover 58 aligned with passage 64. Nipple 66 is threaded into body 57 and against the side wall of cover 58. The tubular member of hose 33 fits over nipple 66 to provide air communication with passage 64 and the passage in tubular member 33.

A second lateral passage 68 intersects the mid-section of main passage 62. A nipple 69 having a longitudinal passage projects through hole 71 in side wall of cover 58 and is threaded into body 57 in alignment with passage 68. The tubular member or hose 34 fits onto nipple 69 to provide an air passage between the passage 68 and the passage in tubular member 34.

Figure 5:
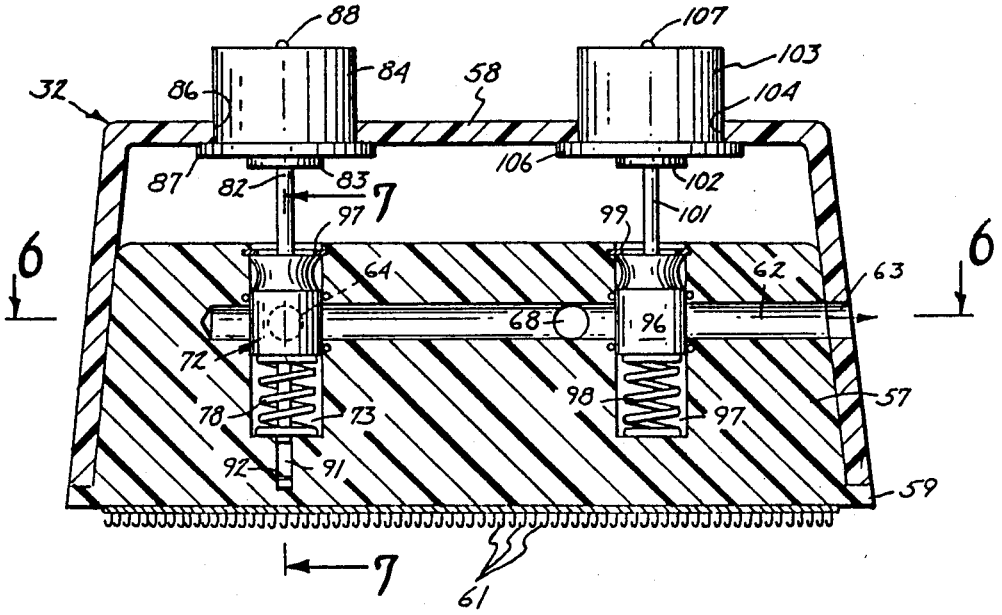
FIG. 5 is a sectional view taken along line 5—5 of FIG. 3.
Figure 3:
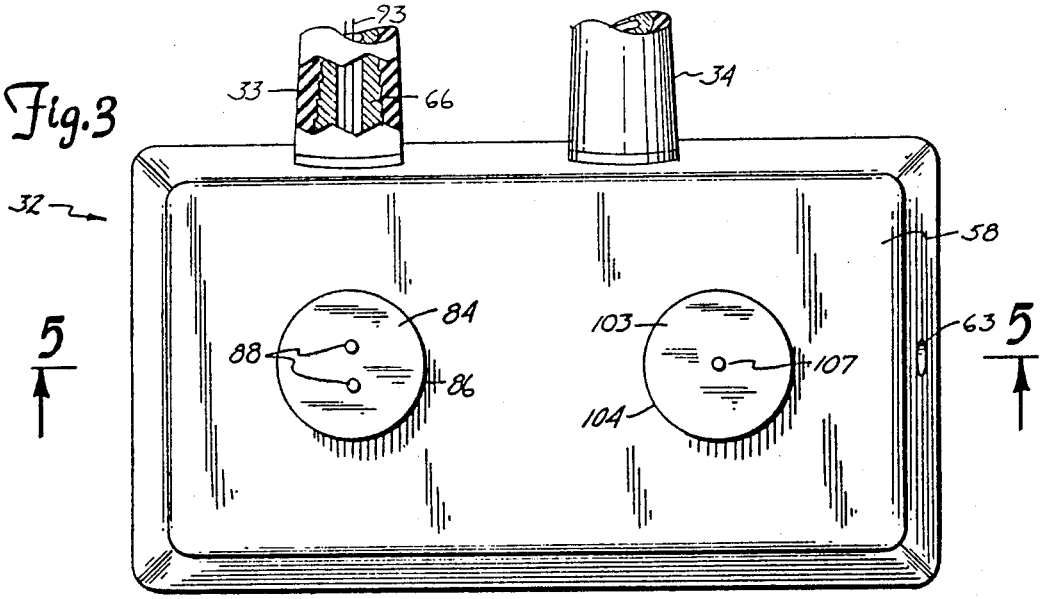
FIG. 3 is an enlarged top view of a hand control of the air control apparatus.
Figure 4:
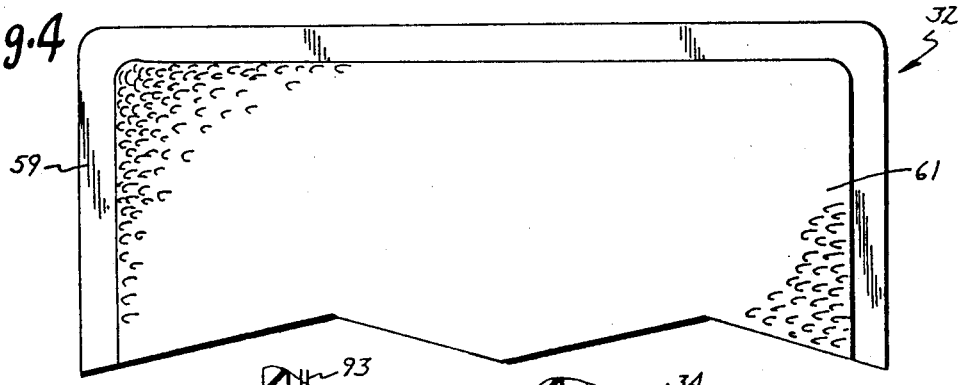
FIG. 4 is a fragmentary bottom view of FIG. 3.

As shown in FIGS. 5 and 6, a first spool valve 72 is slidably disposed in a bore 73 that intersects the juncture of passage 62 and 64 to block the flow of air from passage 64 to passage 62, which is in communication with the air bladder 19 via the nipple 66 and hose 34.

As shown in FIG. 7, spool valve 72 has a cylindrical section 74 and a groove section 76. A split ring 77 located in the upper end of bore 73 and seated into an annular groove in body 57 holds spool valve 72 in sliding assembled relation with bore 723. A coil spring 78 located in the bottom of bore 73 biases spool valve 72 to an up and closed position. A pair of O-rings 79 and 81 engage opposite portions of cylindrical section 74 when valve 72 is in the closed position to prevent leakage of air from passages 62 and 64 to the atmosphere. Returning to FIG. 5, an upwardly directly rod 82 is secured to the top of groove section 76. The upper end of rod 82 has a generally cylindrical head 83. The head 83 engages the lower side of an actuator or button 84. Button 84 has a cylindrical member that is slidably disposed in a hole 86 in the top of cover 58. The lower portion of button 84 has an outwardly directed flange 87 that bears against the bottom of the top cover 58 when button 84 is in the up position and spool valve 72 is in the closed position. The top surface of button 84 has a pair of upwardly directed projections 88 that function as digital sensing indicia that allow a person to digitally sense button 84 without visually observing it.

Returning to FIG. 7, a downwardly directed cylindrical finger 89 is secured to the bottom of cylindrical section 74. Finger 89 extends into a downwardly directed hole 91. Electrical switch contacts 92 located in the bottom of hole 91 are adapted to be actuated on engagement with the finger 89. Switch contacts 92 comprise a normally open electric switch. Switch contacts 92 are coupled to electrical lines 93 that extend through a passage 94 into passage 64. Electrical lines 93 pass through nipple 66, as shown in FIG. 6, and the passage in tubular member 33 to one-way valve 56. As shown in FIG. 2, an electrical line 95 connected to line 93 at valve 56 leads to solenoid control 51. When switch contacts 92 are closed by depressing button 84, the control 51 is energized, whereby coil 49 reciprocates core 44 which moves flexible diaphragm 42 in opposite directions to effect the movement of air into and out of chambers 39A and 39B. When the button 84 is depressed, groove section 76 is located in alignment with passages 62 and 64 whereby the air under pressure from pump 23 flows through the hand control 32 and tubular member 34 to inflate the air mattress 19. The firmness of the air bladder 19 is a function of the amount and pressure of the air supplied thereto. This firmness can be regulated by the duration in which button 84 is depressed.

A second spool valve 96, shown in FIGS. 5 and 6, is slidably disposed in a bore 97 intersecting main passage between passage 68 and the outlet end of main passage 62. Spool valve 96 is identical in construction to spool valve 72. As shown in FIG. 5, valve 96 has a cylindrical portion and a grooved portion. A spring 98 in the bottom of bore 97 biases spool valve 96 in an upward closed position against a split ring 99 located in the upper end of bore 97 and seated in a groove in body 57. The upper end of spool valve 96 has an upwardly directed rod 101 terminating in a generally cylindrical head 102. Head 102 engages the bottom of button 103. Button 103 is a cylindrical actuator that is slidably disposed in circular hole 104 in the top of cover 58. The bottom of button 103 has an outwardly directed flange 106 that bears against the inside of the top cover 58. Spring 98 functions to bias button 103 in an upward direction. The top of button 103 has a projection 107 that serves as a digital sensor to facilitate the location of the button without visual observation. Projection 107 can be deleted from button 103. The smooth top of button 103 can function as a digital sensor since projections 88 identify button 84.

Button 103 is depressed to open to spool valve 96. When the groove portion of spool valve 96 is aligned with air passage 62, the passage 62, as well as the lateral passage 64, are open to the atmosphere through hole 63 and cover 58. The air under pressure in air bladder 19 can vent through hand control unit 32, whereby the operator can adjust the softness of the air bladder 19.

Hand control 27 has a pair of buttons 84A and 103A. When button 84A is depressed, the spool valve associated with the button is open and the switch is turned on, whereby the pump 23 operates to pump air via hose 28 to hand control 27. The air flow through the hand control 27 into hose 29 to increase the pressure of the air in the air bladder. This forms the air bladder. The air bladder 18 can be softened by allowing the air to evacuate from it through hose 29 and hand control 27. Button 103A is depressed, whereby the air can flow through the hand control 27 to the atmosphere.

Figure 8:
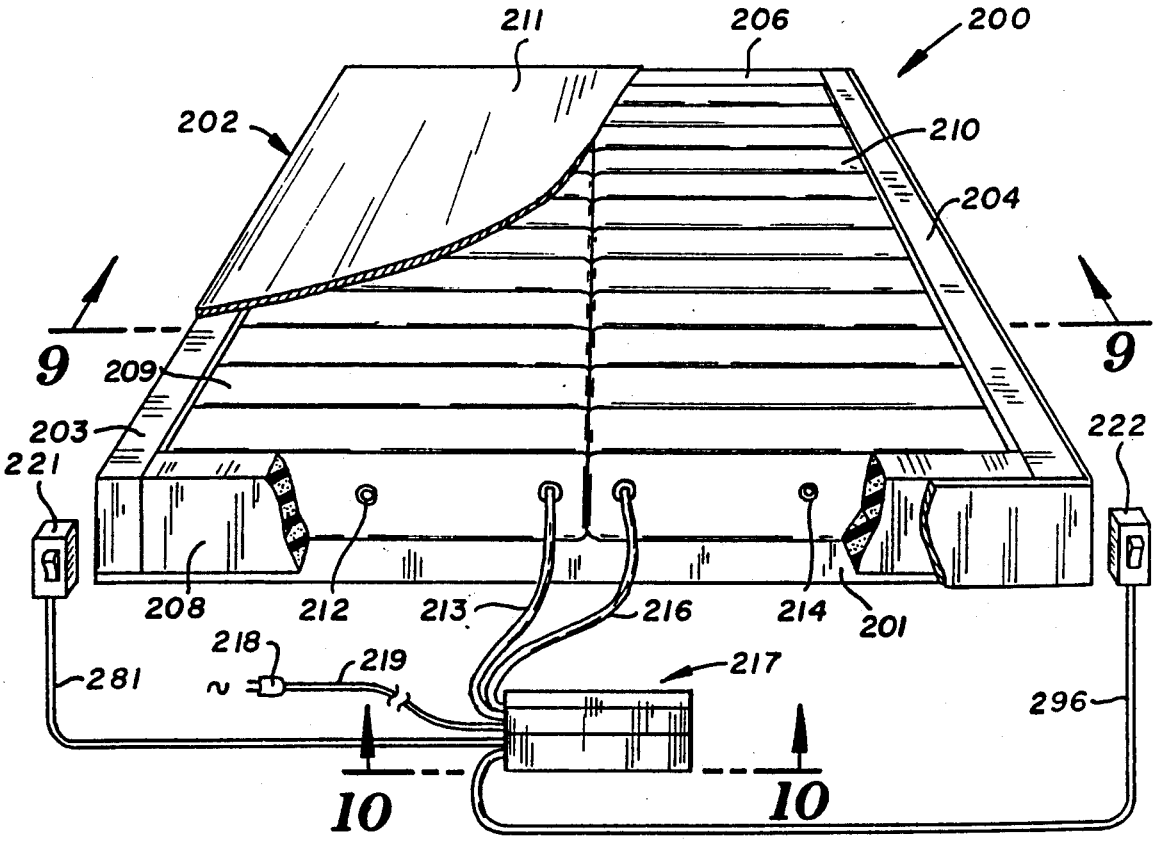
FIG. 8 is a perspective view of an air bed, partly sectioned, equipped with the first modification of the air control apparatus of the invention.
Figure 9:
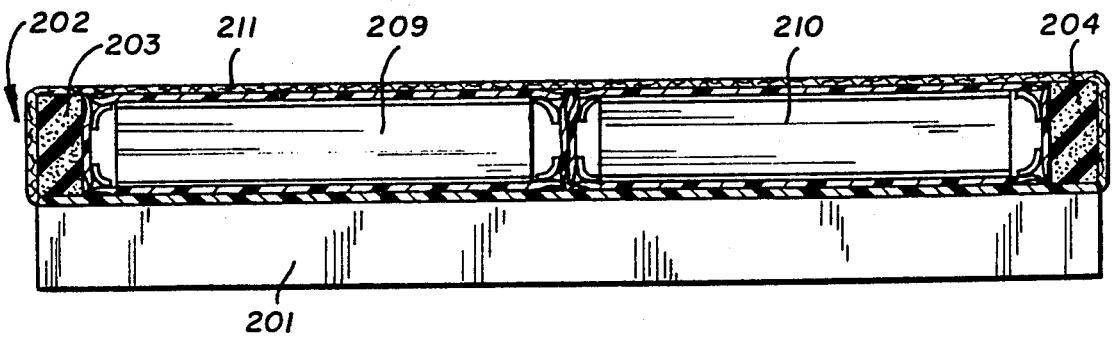
FIG. 9 is an enlarged sectional view taken along the line 9—9 of FIG. 8.

Referring to FIGS. 8 and 9, there is shown a first modification of the air control system of the invention for an air bed in association with a resilient support of air bed indicated generally at 200. Air bed 200 has a generally rectangular base or box-spring unit 201 supporting a mattress unit 202. Mattress 202 has resilient side members 203 and 204 joined to transverse end members 206 and 208. A pair of air bladders or mattresses 209 and 210 are located in the cavity formed by side members 203 and 204 and end members 206 and 208. Air bladders 209 and 210 are air mattresses described in applicant's U.S. Pat. No. 4,644,597. Air mattresses of U.S. Pat. No. 4,644,597 are incorporated herein by reference. A mattress cover 211 is positioned over the air bladders 209 and 210 and around the side and end members 203, 204, 206, and 208. Air bladder 209 has a pressure relief valve 212 and an air hose 213 for delivering air to the air bladder and venting air therefrom. The second air bladder 210 is identical to air bladder 209. Bladder 210 has a pressure relief valve 214 and a flexible air hose 216. Air hoses 213 and 216 are connected to an air supply and control apparatus 217 operable to selectively or concurrently supply air under pressure to air bladders 209 and 210 to inflate the same. Air control apparatus 217 is also operable to vent the air from air bladders 209 and 210 to regulate the firmness of the air bladders.

An electrical plug 218 is adapted to be connected to the conventional AC power receptacle. An electrical line 219 connects plug 218 to air control apparatus 217. A pair of remote hand controls 221 and 222 are used to operate the air control apparatus 217 to selectively inflate and deflate air bladders 209 and 210.

Figure 11:
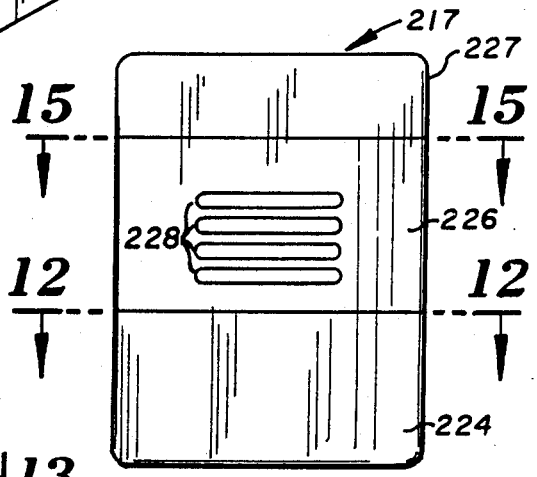
FIG. 11 is an end view of the right end of FIG. 10.

Air control apparatus 217 has a box-shaped casing indicated generally at 223. The casing 223 has three sections that are secured together comprising a bottom section 224, a center section 226 and a top section 227. As shown in FIG. 11, center section 226 has a plurality of air inlet openings 228 to allow air to flow into a first chamber 229. A plurality of bolts 231 secure the bottom, center, and top sections together.

Figure 12:
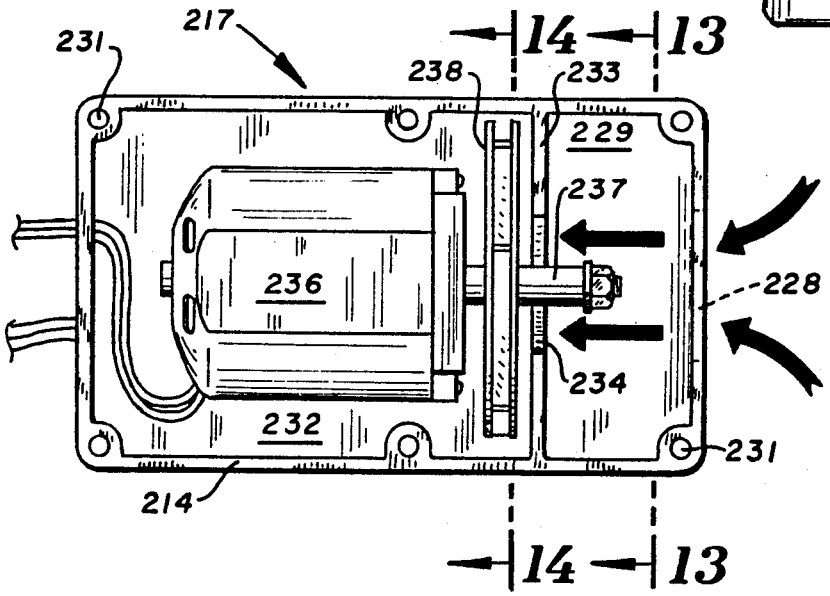
FIG. 12 is a sectional view taken along the line 12—12 of FIG. 11.
Figure 13:
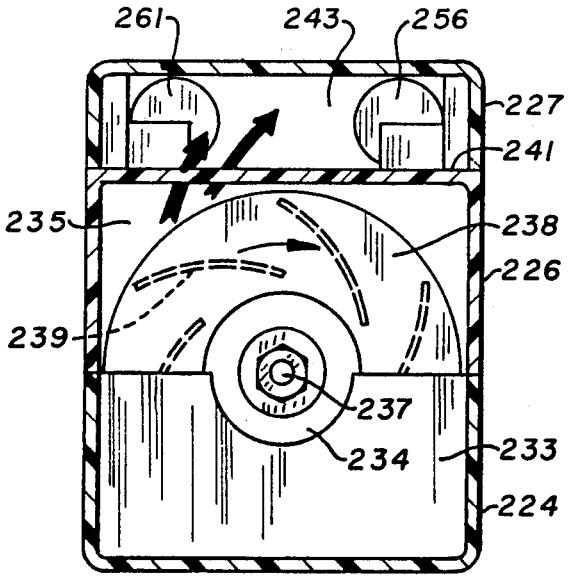
FIG. 13 is a sectional view taken along the line 13—13 of FIG. 12.
Figure 14:
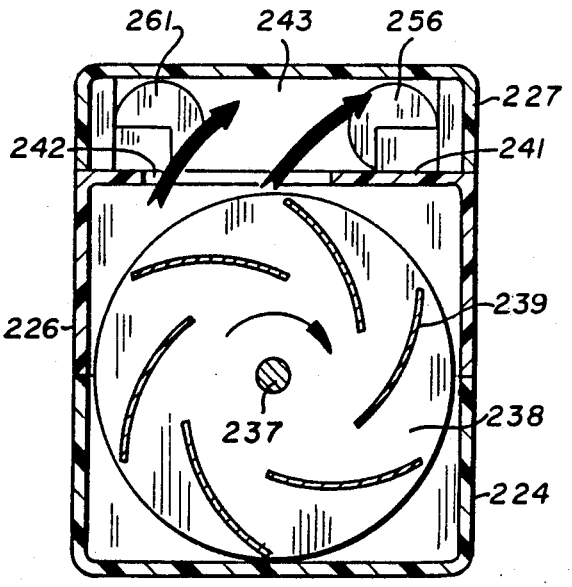
FIG. 14 is a sectional view taken along the line 14—14 of FIG. 12.
Figure 15:
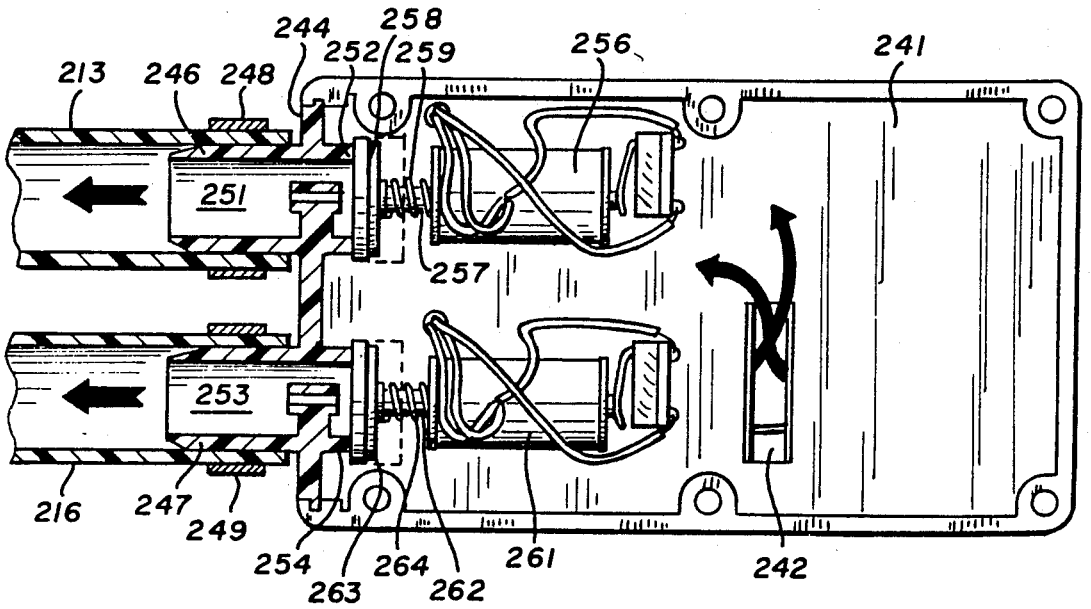
FIG. 15 is a sectional view taken along the line 15—15 of FIG. 12.

As shown in FIG. 12, bottom section 224 has a second chamber 232 separated from the first chamber 229 with a generally upright wall 233. Wall 233 has an opening 234 allowing air to flow from chamber 229 into chamber 232. As shown in FIG. 13, center section 226 has a wall 235 that is in vertical alignment with wall 233. Returning to FIG. 12, an electric motor 236 is located in chamber 232. Motor 236 is secured to the base of the bottom section 224. Motor 236 has a horizontal drive shaft 237 extended through opening 234. An impeller 238 is mounted on the drive shaft 237 adjacent walls 233 and 235. Impeller 238 has a plurality of circumferentially spaced vanes 239. As shown in FIG. 14 and 15, the top wall 241 of center section 226 has a generally rectangular opening 242 in alignment with the top of impeller 238. The opening 242 provides air communication between chamber 232 and top chamber 243 defined by the casing cover of top section 227.

Figure 10:
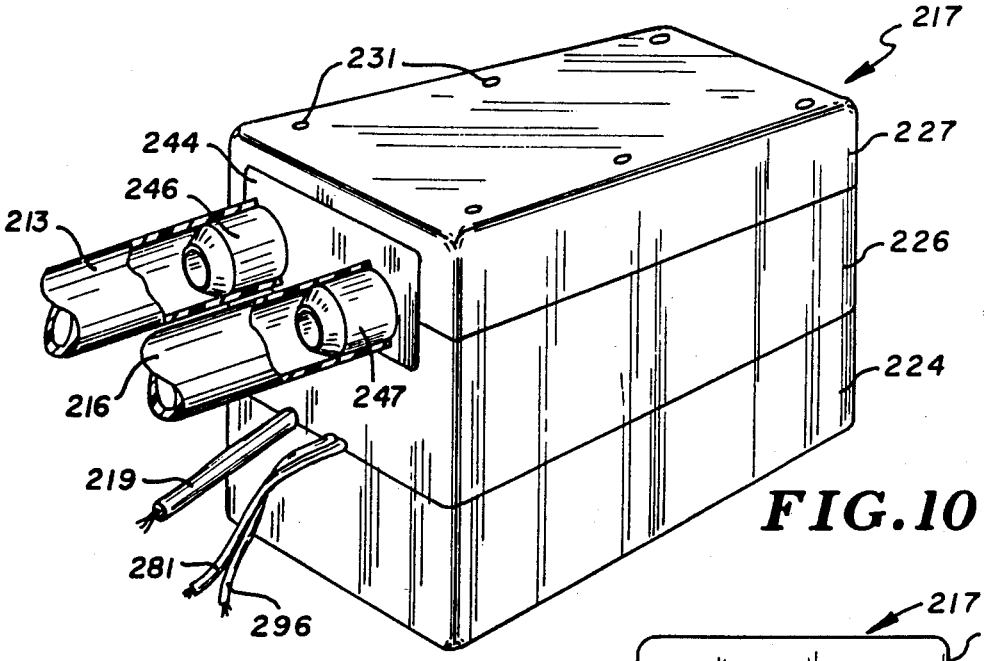
FIG. 10 is a perspective view of the air control apparatus of FIG. 8.

As shown in FIGS. 10 and 15, a plate 244 is attached to an end of the center section 226 and top section 227. Plate 244 supports a pair of tubular connectors or nipples 246 and 247. Hose 213 is located on nipple 246 and retained thereon with a band clamp 248. Hose 216 is located on nipple 247 and retained thereon with clamp 249. Nipple 246 has a passage 51 surrounded by an internal annular lip 252. Passage 251 is in communication with the passage in hose 213. Nipple 247 has a passage 253 surrounded by an internal annular lip 254. Passage 253 is in communication with hose 216. Lips 252 and 254 surround the ends of nipples 246 and 247 open to the top chamber 243. The air under pressure in top chamber 243 flows through the nipples and hoses to inflate air mattresses 209 and 210.

As shown in FIG. 15, a first solenoid 256 is supported on the top wall 241 adjacent annular lip 252. Solenoid 256 has a movable plunger 257 supporting a valve head 258. The valve head 258 has a rubber pad biased in sealing engagement with annular lip 252 with a coil spring 259. Spring 259 is positioned around plunger 257 and normally holds the head 258 in a closed position in sealing engagement with annular lip 252 to prevent venting of air from air mattress 209. A second solenoid 261 is located in longitudinal alignment with nipple 247. Second solenoid 261 has a plunger 262 secured to valve head 263. Head 263 is biased into engagement with annular lip 254 with a coil spring 264. When solenoids 256 and 261 are actuated, the valve heads 258 and 263 move away from the adjacent annular lips 252 and 254 to open the passages 251 and 253. When motor 236 is operating, the air pumped by the rotating impeller 238 will flow through passages 251 and 253 and hoses 213 and 216 to inflate air mattresses 209 and 210. When motor 236 is not operating, solenoids 256 and 261 can be energized to move valve heads 258 and 263 to their open positions thereby allowing the air in the air mattresses 209 and 210 to vent the atmosphere. The firmness of each air mattress can be adjusted by varying the pressure of the air in the mattress.

Figure 16:
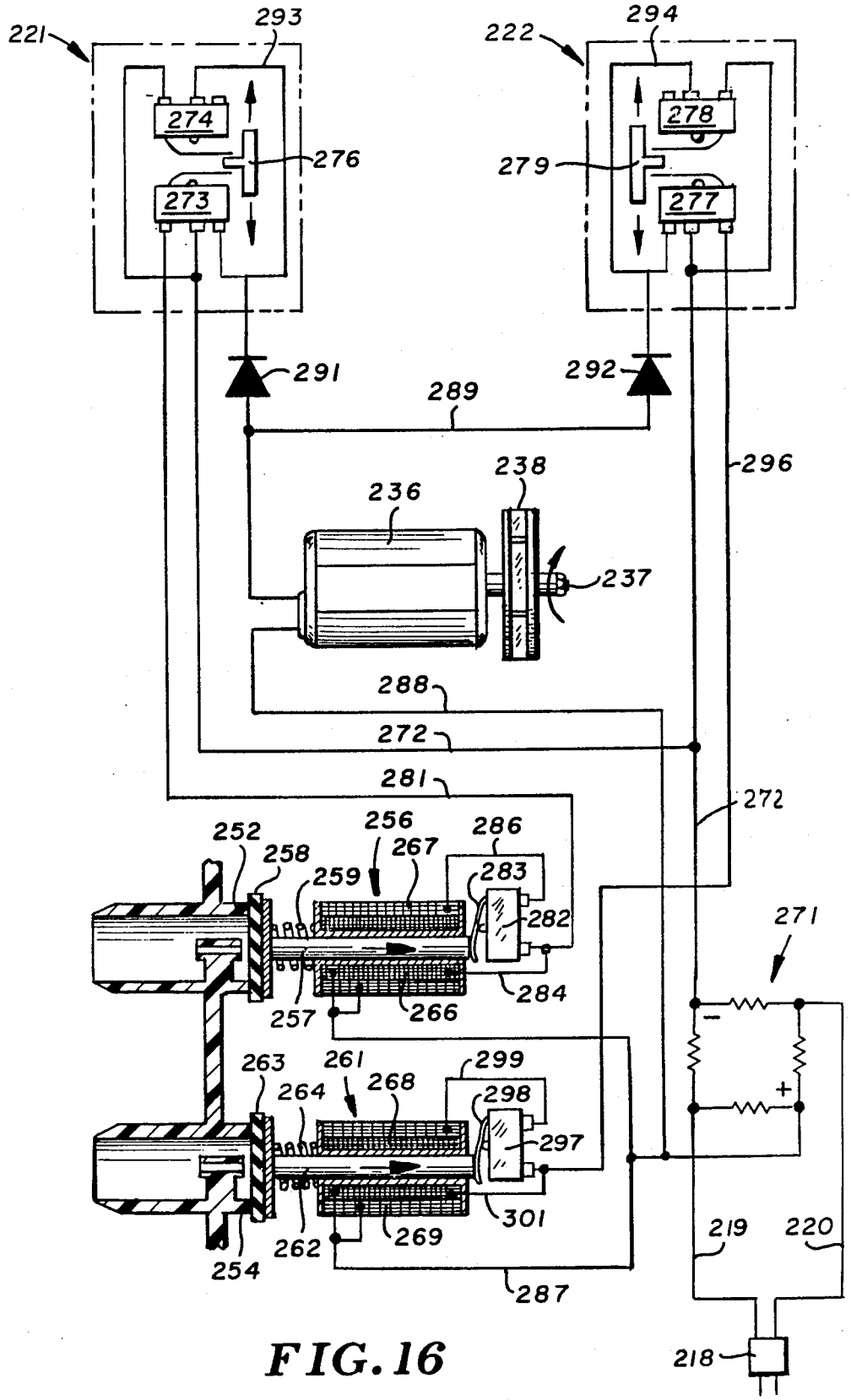
FIG. 16 is a diagrammatic view of the electrical control circuit of the air control apparatus of FIG. 8.

Referring to FIG. 16, there is shown the electrical circuit control for air control apparatuses 217. The control is used to operate electric motor 236 and solenoids 256 and 261 for supplying air to the air mattresses and venting the air from the air mattress.

First solenoid 256 has first and second coils 266 and 267 located about a center passage. Plunger 257 is slidably located in the center passage. Coils 266 and 267 are wound in the same direction so that both coils create a concurrent magnetic field that causes plunger 257 to move against spring 259 to move head 258 away from annular lip 252. This opens the passage leading to air mattress 209. When motor 236 is operated, the air will flow into air mattress 209. When motor 236 is not operating, the air will vent from air mattress 209.

Second solenoid 261 is the same construction as the first solenoid 256. It has a movable plunger 262 connected to a head 263. A spring 264 normally biases the head into engagement with the annular lip 254 to close the passage leading to air mattress 210. Second solenoid 261 has first and second coils 268 and 269 that are wound in the same direction to provide a concurrent magnetic field operable to move plunger 262 and head 263 away from annular lip 254. This opens passage to the second air mattress 210.

The electrical receptacle plug 218 is joined to two electrical lines 219 and 220 leading to a resistance bridge rectifier 271. Rectifier 271 converts AC power to DC power. Lines 219 and 220 are connected to opposite sides of the rectifier 271. The negative terminal of rectifier 271 is connected with a line 272 leading to hand controls 221 and 222. Hand control 221 has first and second switches 273 and 274 selectively actuated with hand operated actuator or button 276 as shown by the arrows. Hand control 222 has first and second switches 277 and 278 selectively actuated with an actuator or button 279 as shown by the arrow. Line 272 is connected to switches 273, 274, 277 and 278.

A line 281 connects switch 273 to a second normally closed switch 282 having a lever actuator 283. The lever actuator 283 is located in alignment with the end of the plunger 257 of solenoid 256. When solenoid 256 is energized the normally closed switch 282 is opened by the movement of the plunger 257 into engagement with the lever actuator 283. A line 284 connects line 281 to the first coil 266. A second line 286 connects switch 282 to the second coil 267. When switch 282 is open second coil 267 is de-energized. Coils 266 remains energized as long as the switch 273 is closed. The plunger 267 and head 258 are held in the open position by the magnetic field of coil 266 to allow air to flow through nipple 252. Coils 266 and 267 are connected with a line 287 to the positive terminal of bridge rectifier 271. Line 287 is also connected to the coils 268 and 269 of solenoid 261.

Bridge rectifier 271 is connected with a line 288 to the electric motor 236. A second line 289 connected to motor 236 is joined to separate diodes 291 and 292. The diodes 291 and 293 are located parallel in lines 293 and 294 leading to switches 274 and 278 respectively. When switch actuators 276 and 279 are moved to the up positions, closing switches 274 and 278, solenoids 256 and 261 are energized opening valves 258 and 263 and motor 236 will be energized thereby rotating impeller 238 to pump air into the air mattress 209 and 210. Switches 276 and 279 may be separately actuated to control the inflation of the separate air mattresses 209 and 210.

A line 296 connects switch 277 to a second switch 297 having a lever actuator 298 located in engagement with the end of the plunger 267 of solenoid 261. When the solenoid 261 is energized, the plunger 267 engages the lever actuator 298 to open the normally closed switch 297. A line 299 connects switch 297 to the second coil 269. A line 301 connects the switch 297 to the first coil 268. Lines 296 and 301 are connected to a common terminal of switch 297 so that the first coils 268 will be continuously energized when switch 277 is closed.

In use, the bridge rectifier 271 converts the AC power to DC power for the solenoids 256 and 261. This minimizes solenoid failure and allows the use of smaller solenoids. The DC solenoid does not have the noise of an AC powered solenoid.

When the switch actuator 276 is moved to the up position to close the switch 274, the electric motor 236 will be energized and the solenoid 256 will be energized. Both coils 266 and 267 will be initially supplied with the electric DC power. This moves plunger 257 into an open position against spring 264. The motor 236 rotating the impeller 238 supplies air under pressure which flows into the air mattress 209. When plunger 257 engages the actuator lever 283, the normally closed switch 282 will be opened. This terminates the power supply to the second coil 267. The power supply to the first coil 266 remains and is sufficient to hold the plunger 257 in the open position. The termination of the DC power to coil 267 avoids overheating and burn out of solenoid 256. When switch actuator 276 is returned to its middle or off position, the power to motor 236 is terminated as well as the power to solenoid 256. Spring 259 immediately returns plunger 257 and head 258 attached thereto to the closed position. Head 258 functions as a valve to prevent the air from venting from air mattress 209.

When switch actuator 276 is moved to the down or soft position, switch 273 is closed. Electric DC power is supplied to the solenoid 256 to open valve head 258. Plunger 257 will engage the lever actuator 283 thereby opening the normally closed switch 282. Plunger 257 will remain in the open position by the magnetic field established by first coil 266. Air will vent from the air mattress as long as the switch actuator 276 is in its down or soft position closing switch 273. Electric motor 236 does not operate as it is not connected electrically to switch 273.

Figure 17:
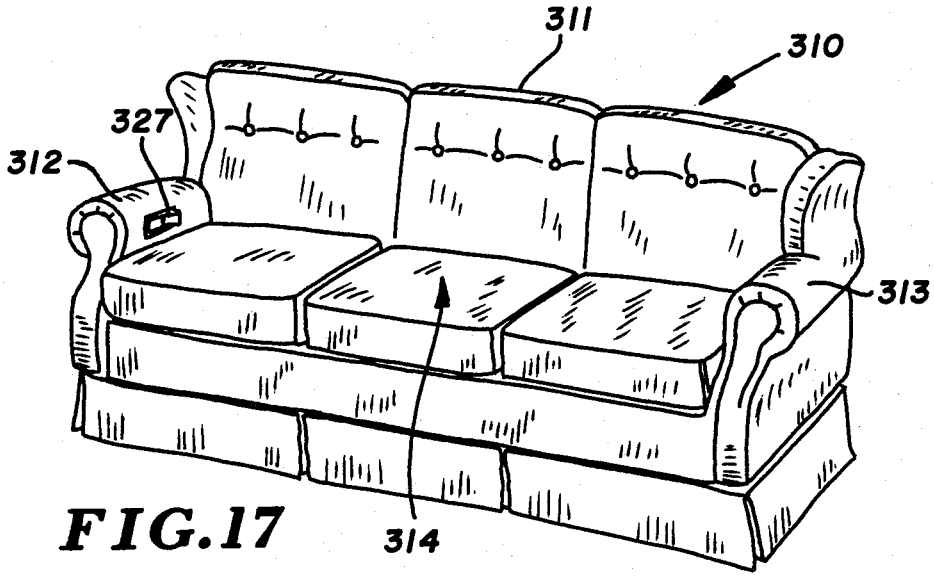
FIG. 17 is a perspective view of the sofa sleeper in the sitting or sofa position equipped with a second modification of an air mattress and air control apparatus of the invention.
Figure 18:
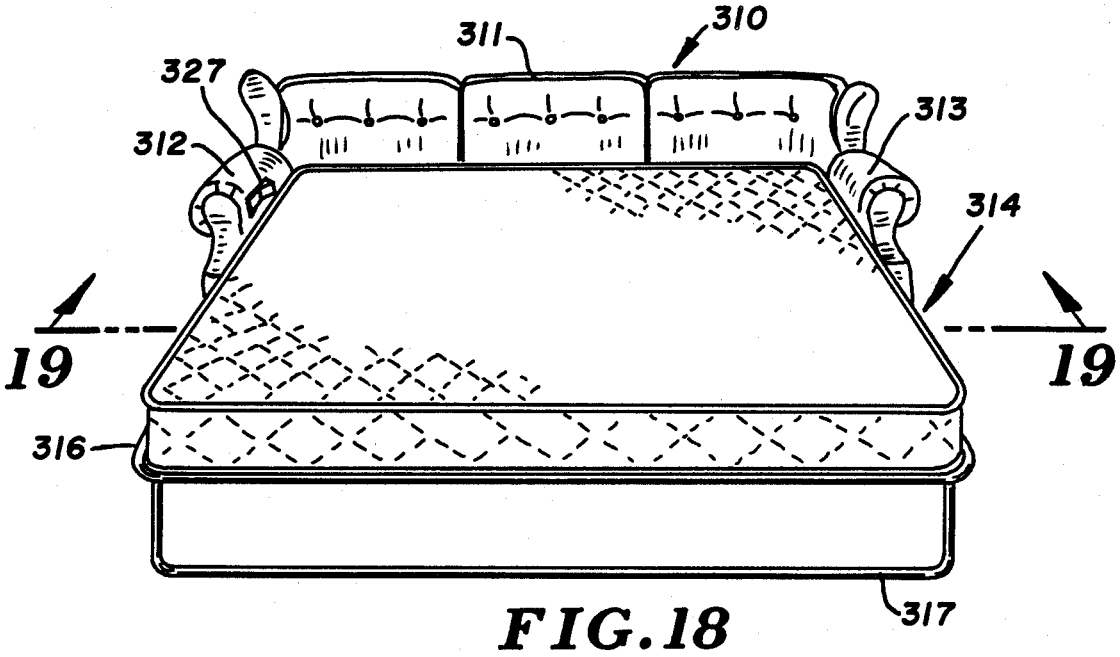
FIG. 18 is a perspective view of the sofa sleeper of FIG. 17 open to the bed position with the air mattress inflated.
Figure 19:
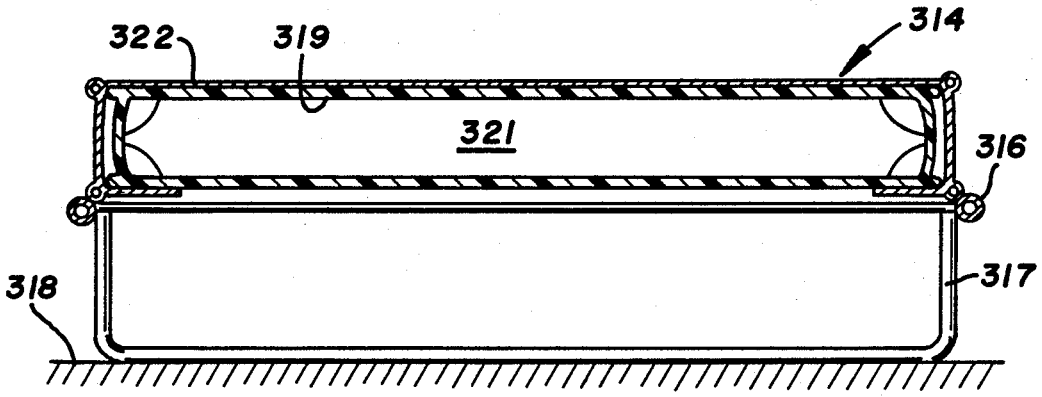
FIG. 19 is an enlarged sectional view taken along the line 19—19 of FIG. 18.

Referring to FIGS. 17 to 31, there is shown a second modification of the air control system of the invention for an air mattress in association with a sofa sleeper indicated generally at 310. Sofa sleeper 310 has a generally upright back section 311 joined to a pair of side arms 312 and 313, as shown in FIGS. 17 and 18. A mattress assembly indicated generally at 314 is connected to back section 311. Referring to FIG. 19, mattress assembly 314 comprises an air mattress 319 adapted to be supported on a folding frame 316. Frame 316 has a plurality of support legs 317 that engage floor 318 when mattress assembly 314 is open to the bed position. Mattress 319 has top, bottom, side and end walls defining an inner air chamber 321. Examples of air mattresses are shown in U.S. Pat. No. 4,644,597. A mattress cover 322 is positioned over the top wall of mattress 319 and around the side and end walls of the mattress.

Figure 20:
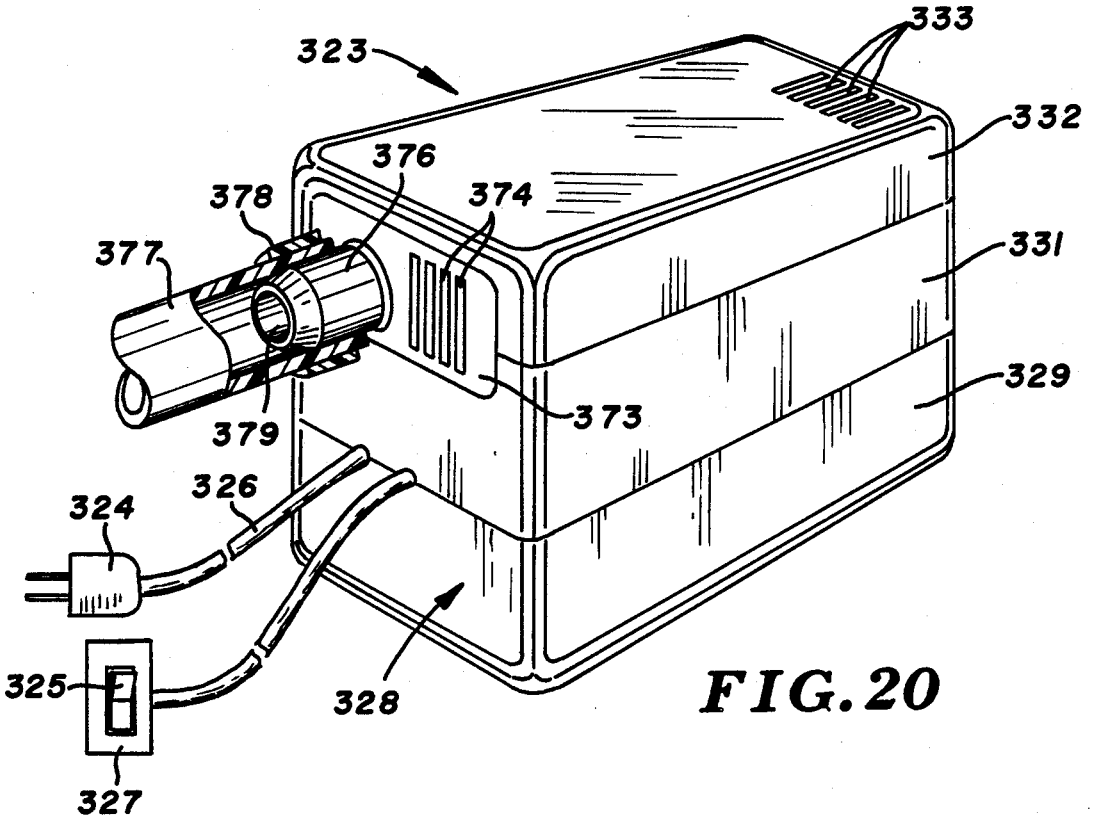
FIG. 20 is a perspective view of a modification of the air control apparatus of the invention used in the sofa sleeper of FIG. 17.

As shown in FIG. 20, an air hose 377 is connected to an air pump and control apparatus indicated generally at 323 operable to supply air under pressure to mattress chamber 321 to inflate the same. Air control apparatus 323 is also operable to evacuate air from chamber 321 to allow the mattress assembly 314 to fold up into a sitting or sofa position, as shown in FIG. 17.

As shown in FIG. 20, an electrical plug 324 is adapted to be connected to the conventional AC power receptacle. An electrical line 326 connects plug 324 to air control apparatus 323. A remote hand control 327 having a hand operated actuator 325 is used to operate air control apparatus 323 to selectively inflate and deflate air mattress 319. Hand control 327 is mounted on the inside of sofa side arm 312 so as to be accessible to the person on the sofa bed.

Figure 21:
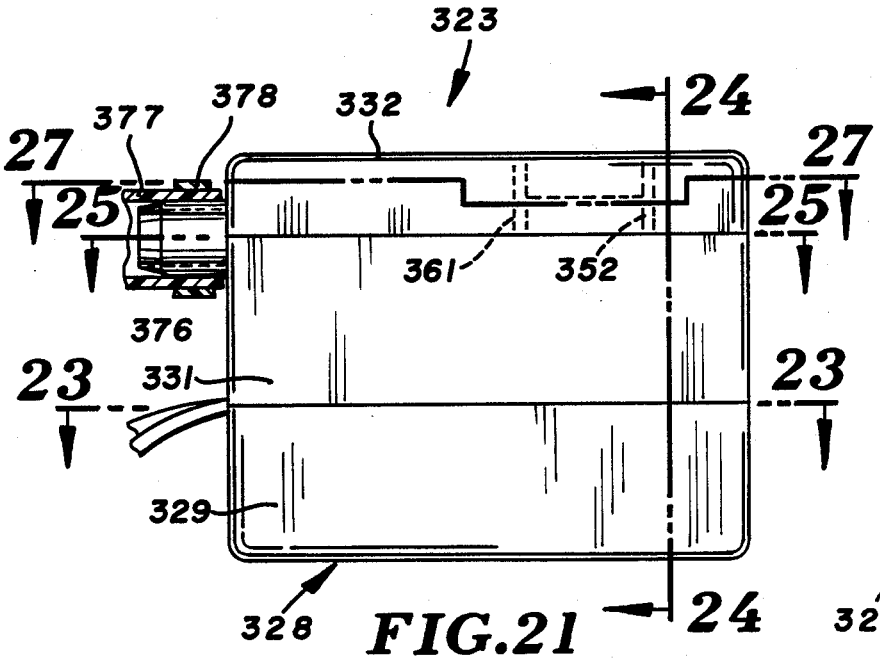
FIG. 21 is a side elevational view, partly sectioned, of the air control apparatus shown in FIG. 20.
Figure 22:
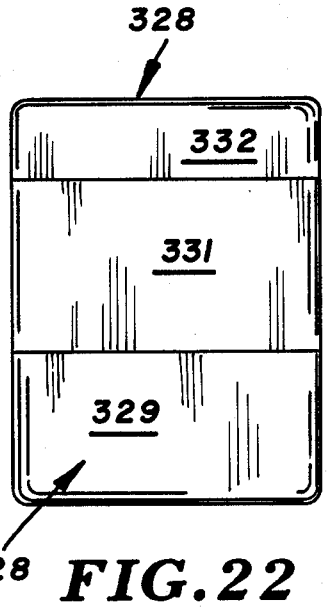
FIG. 22 is an end elevational view of the rear of the air control apparatus shown FIG. 20.

Referring to FIGS. 20 to 22, air control apparatus 323 has a box-shaped casing indicated generally at 328. The casing 328 has three sections that are secured together comprising a bottom section 329, a center section 331, and a top section 332. As shown in FIG. 20, top section 323 has a plurality of air inlet openings 333 to allow air to flow into a first chamber 334. A plurality of upright pegs 335, shown in FIGS. 23, 25, and 27, fit into holes in the inner surfaces of the casing to secure the bottom, center, and top sections together.

Figure 24:
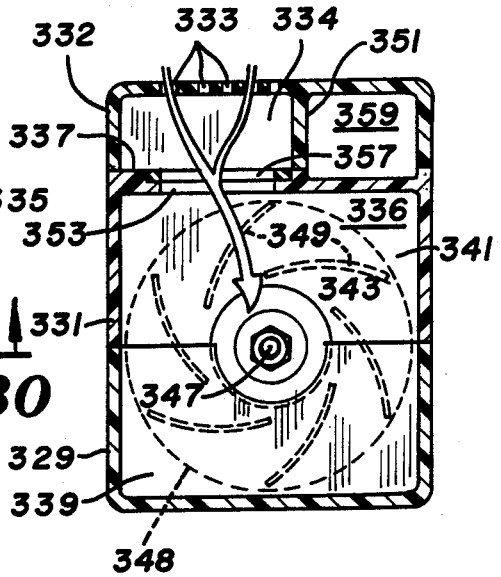
FIG. 24 is a sectional view taken along the line 24—24 of FIG. 21.
Figure 27:
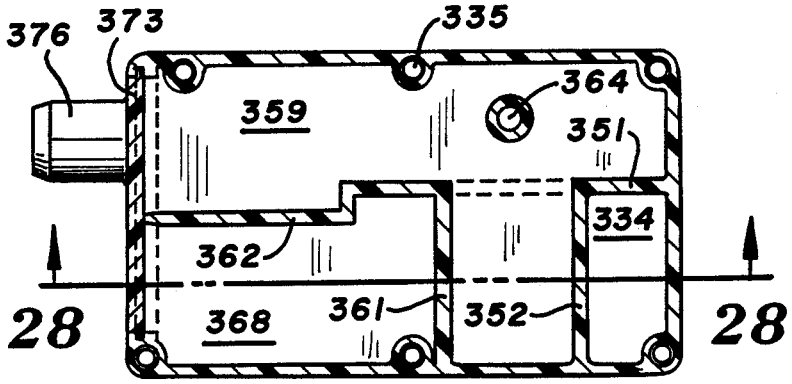
FIG. 27 is a sectional view taken along the line 27—27 of FIG. 21.
Figure 29:
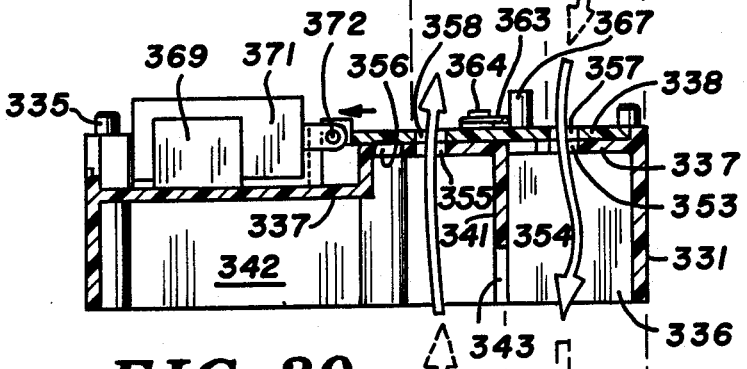
FIG. 29 is a sectional view taken along the line 29—29 of FIG. 25.

As shown in FIGS. 24 and 27, first chamber 334 is defined by a pair of generally upright walls 351 and 352 and the casing cover of top section 332. Center section 331 and bottom section 329 have a common second chamber 336 separated from the first chamber with a generally horizontal wall 337. As shown in FIG. 29, wall 337 has a plurality of rectangular shaped openings 353, 354, 355, and 356 allowing air to flow through the air control apparatus 323.

Figure 23:
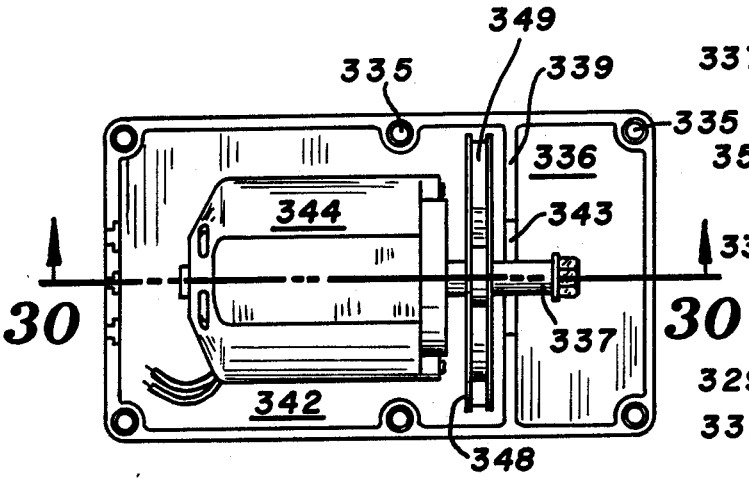
FIG. 23 is a sectional view taken along the line 23—23 of FIG. 21.
Figure 28:
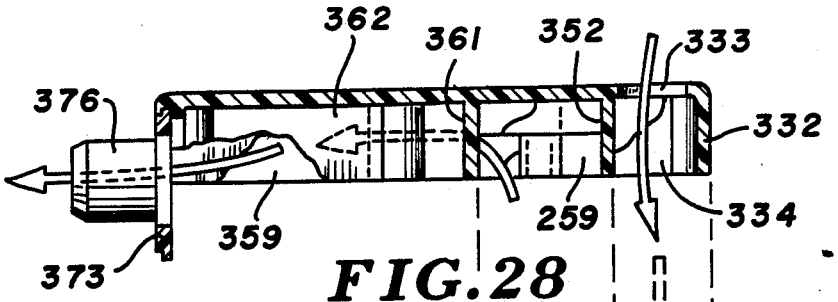
FIG. 28 is a sectional view taken along the line 28—28 of FIG. 23.
Figure 30:
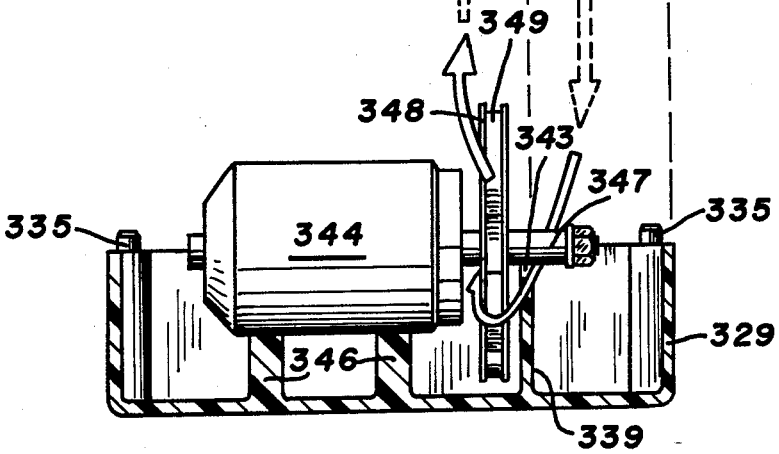
FIG. 30 is a sectional view taken along the line 30—30 of FIG. 27.

Referring to FIGS. 24 and 30, bottom section 329 has a generally upright wall 339 that is in vertical alignment with a wall 341 located in center section 331. Walls 339 and 341 separate second chamber 336 from a third chamber 342. The walls 339 and 341 have central recesses that face each other to form an opening 343 allowing air to flow from chamber 336 into chamber 342. As shown in FIGS. 23 and 28, an electric motor 344 is located in chamber 342. Motor 344 is secured to upright legs 346 connected to the base of bottom section 329. Motor 344 has a horizontal drive shaft 347 extended through opening 343. An impeller 348 is mounted on the drive shaft 347 adjacent walls 339 and 341. Impeller 348 has a plurality of circumferentially spaced curved vanes 349. As shown in FIGS. 28 and 29, openings 355 and 356 in wall 337 are in general alignment with top of impeller 348. The opening 355 provides air communication between chamber 342 and a top chamber 359 defined by the casing cover of top section 332 and upright walls 351, 352, 361, and 362. Opening 356 provides air communication between chamber 342 and an exhaust chamber 368 defined by the casing cover of top section 332 and upright walls 361 and 362.

Figure 25:
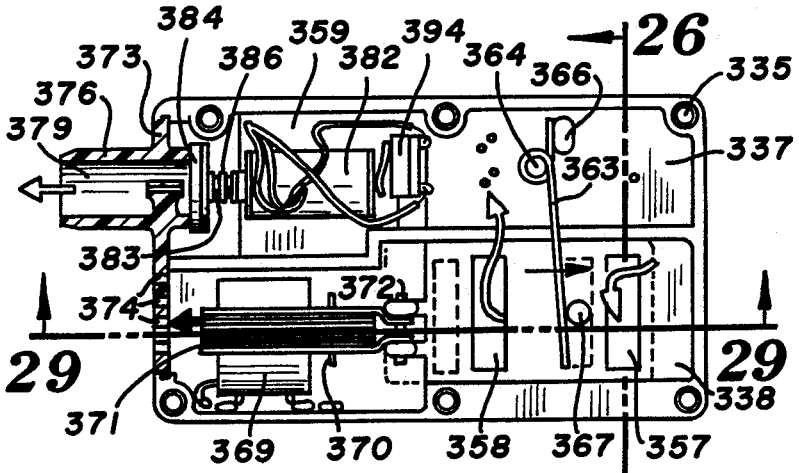
FIG. 25 is a sectional view taken along the line 25—25 of FIG. 21.

Referring to FIG. 25, a flat rectangular shaped gate 338 having rectangular openings 357 and 358 is slidably mounted on wall 337 to control the flow of air through apparatus 323. Gate 338 is selectively movable between a first position, shown in full lines, and a second position, shown in broken lines, with respect to wall 337. As shown in FIG. 29, gate openings 357 and 358 are in alignment with openings 353 and 355, respectively, when gate 338 is moved to the first position. The air in first chamber 334 is allowed to flow through second and third chambers 336 and 342 and into the top chamber 359 to inflate air mattress 319. When gate 338 is moved to the second position, gate openings 357 and 358 are in alignment with openings 354 and 356, respectively allowing the air in top chamber 359 to flow through second and third chambers 336 and 342 and into exhaust chamber 368 to draw air out of the air mattress 319.

Figure 26:
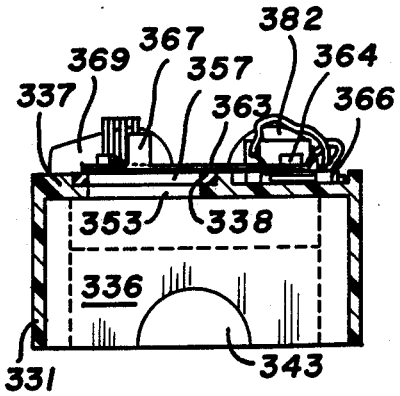
FIG. 26 is a sectional view taken along the line 26—26 of FIG. 25.

Referring to FIGS. 25 and 26, a spring 363 surrounding an upright post 364 engages a stop member 366 attached to wall 337 and a pin 367 secured to gate 338 biases gate 338 to the first position. A gate solenoid 369 is supported on wall 337 adjacent gate 338. Solenoid 369 has a movable arm 371 attached to the end of gate 338 with a connecting pin 372. When solenoid 369 is actuated, gate 338 is moved from the first position to the second position. Arms 371 has a pair of tabs 370 that engage the cover of solenoid 369 to locate gate 338 in its second position.

As shown in FIGS. 20 and 25, a plate 373 is attached to an end of the center section 331 and top section 332. Plate 373 has a plurality of air outlet openings 374 to allow air to flow out of the exhaust chamber 368. A tubular connector or nipple 376 is supported by plate 373 adjacent outlet openings 374. Returning to FIGS. 20 and 25, hose 377 is located on nipple 376 and retained thereon with a band clamp 378. Nipple 376 has a passage 379 surrounded by an internal annular lip 381. Passage 379 is in communication with the passage in hose 377. Lip 381 surrounds the end of nipple 376 open to top chamber 359. The air under pressure in top chamber 359 flows through nipple passage 379 and hose 377 to inflate or deflate air mattress 319.

A solenoid 382 is supported on the horizontal wall 337 adjacent annular lip 381. Solenoid 382 has a movable plunger 383 supporting a valve head 384. The valve head 384 has a rubber pad biased in sealing engagement with annular lip 381 with coil spring 386.

Spring 386 is positioned around plunger 383 and normally holds the head 384 in a closed position in sealing engagement with annular lip 381 to prevent venting of air from air mattress 319. When solenoid 382 is actuated, valve head 384 moves away from the adjacent annular lip 381 to open passage 379. When motor 344 is operating and gate 338 is in its first position, the air pumped by the rotating impeller 348 will flow through passage 379 and hose 377 to inflate air mattress 319. When gate solenoid 369 is energized to move gate 338 to its second position, the rotating impeller 348 draws air from air mattress 319 and discharge it to the atmosphere. The firmness of air mattress 319 can be adjusted by varying the pressure of the air in the mattress. Continued operation of the motor 344 with gate 338 in the second position will withdraw or evacuate the air from air mattress 319 whereby the air mattress will become flat. The sofa sleeper 311 can then be folded to its sealing position.

Figure 31:
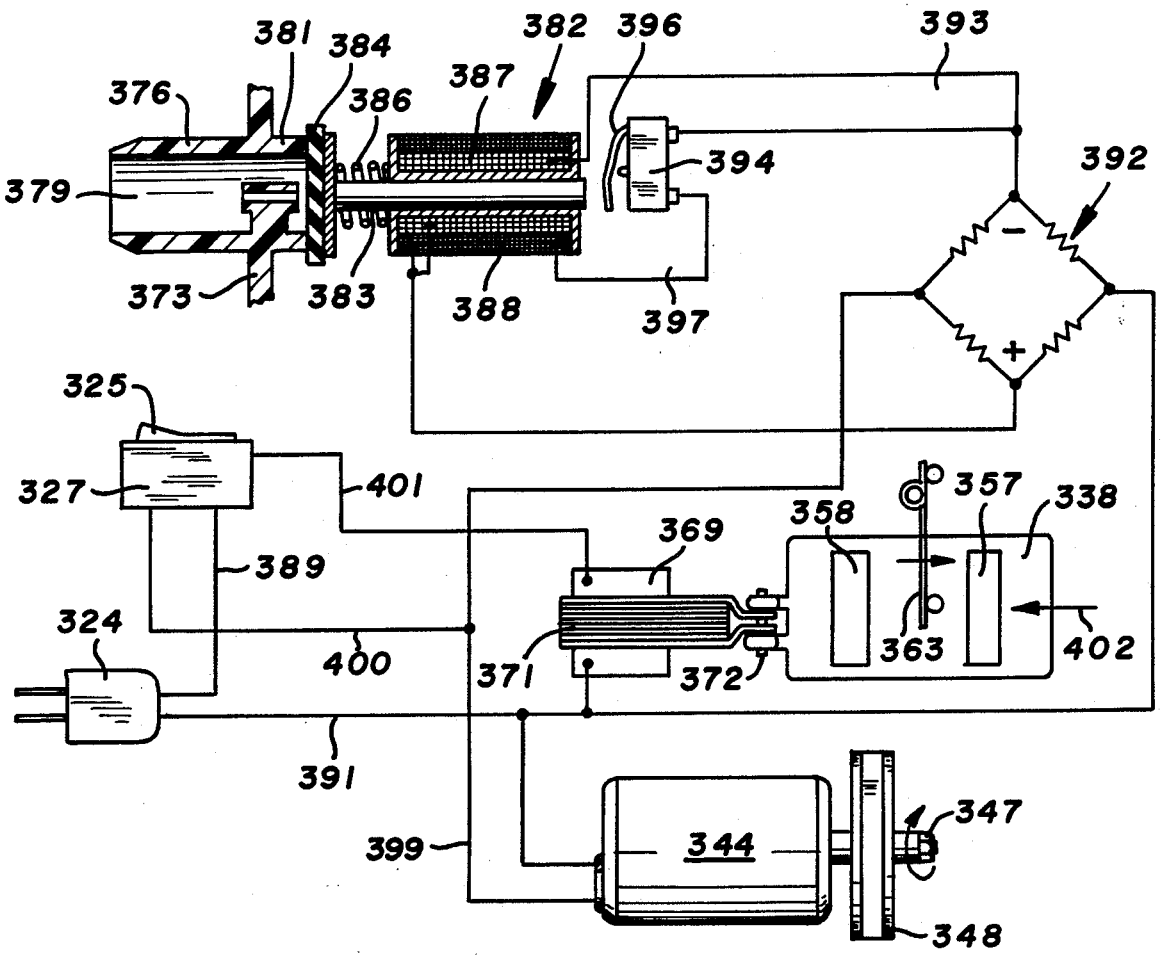
FIG. 31 is an electrical, mechanical diagram of the air control apparatus shown in FIG. 20.

Referring to FIG. 31, there is shown the electrical circuit control for air control apparatus 323. The control is used to operate electric motor 344 and solenoids 369 and 382 for selectively supplying air to air mattress and pumping the air from the air mattress.

Solenoid 382 has first and second coils 387 and 388 located about a center passage. A plunger 383 is slidably located in the center passage. Coil 387 and 388 are wound in the same direction so that both coils create a concurrent magnetic field that causes plunger 383 to move against spring 386 to move head 384 away from the annular lip 381. This opens the passage 379 leading to air mattress 319.

Gate solenoid 369 has a coil (not shown) to provide a magnetic field operable to move arm 271 against spring 363 to move gate 338 from its first position to its second position. Spring 363 biases gate 338 to the first position thereof. This allows motor 344 to pump the air out of air mattress 319.

Electrical receptacle plug 324 is joined to two electrical lines 389 and 391 leading to hand control switch 327 and a resistance bridge rectifier 392. Rectifier 392 converts AC power to DC power. Line 389 is connected to hand control switch 327. Hand control 327 is a conventional three position switch having a first or firm position, a second or soft position, and a middle or off position. Line 391 is connected to gate solenoid 369, electric motor 344, and one side of the rectifier 392. The negative terminal of rectifier 392 is connected with a line 393 that leads to a normally closed switch 394 and the first coil 387. A second line 397 connects switch 394 to second coil 388. Switch 394 has a lever actuator 396 located in alignment with the end of plunger 383 of solenoid 382. When solenoid 382 is energized, the normally closed switch 394 is opened is opened by the movement of plunger 383 into engagement with the lever actuator 396. When switch 394 is open the second coil 388 is de-energized. First coil 387 remains energized as long as switch 327 closed. Plunger 383 and valve head 384 are held in the open position by the magnetic field of coil 387. Coils 387 and 388 are connected with a line 398 to the positive terminal of bridge rectifier 392.

Bridge rectifier 392 is connected with a line 399 to the electric motor 344 and line 400 to switch 327. When switch 327 is moved to its first or firm position, motor 344 will be energized thereby rotating impeller 348 to pump air into the air mattress 319. The switch is held in the second position until the air mattress is deflated.

A line 401 connects switch 327 to gate solenoid 369. When switch 327 is moved to its second or soft position, solenoid 369 will be energized thereby moving gate 338 to its second position. Motor 344 will also be energized causing the impeller 348 to rotate and pump the air out of the air mattress 319.

In use, bridge rectifier 392 converts AC power to DC power for solenoid 382. This minimizes solenoid failure and noise and allows the use of smaller solenoids. When hand control switch 327 is moved to first or firm position, the electric motor 344 will be energized and the solenoid 382 will be energized. Both coils 387 and 388 will be initially supplied with the electric DC power. This moves plunger 383 into an open position against spring 386. The gate solenoid 369 is not operated when switch 327 is in the first mode. Spring 363 holds gate 338 in its first position to align gate openings 357 and 358 with openings 353 and 355, respectively. The motor 344 rotating the impeller 348 supplies air under pressure which flows into air mattress 319. When plunger 383 engages the actuator lever 396, the normally closed switch 394 will be opened. This terminates the power supply to the first coil 387. The power supply to the first coil 387 remains and is sufficient to hold the plunger 383 in the open position. The termination of the DC power to coil 388 avoids overheating and burn out of solenoid 382. When switch is returned to its middle or off position, the power to motor 344 is terminated as well as the power to solenoid 382. Spring 386 immediately returns plunger 383 and head 384 attached thereto to the closed position. Head 384 functions as a valve to prevent the air from venting or leaking from air mattress 319.

When hand control switch 327 is moved to the second or soft position, electric DC power is supplied to the solenoid 382 to open valve head 384. Plunger 383 will engage the lever actuator 396 thereby opening the normally closed switch 394. The plunger 383 will remain in the open position by the magnetic field established by first coil 387. Electric power is supplied to the gate solenoid 369 to move the gate 338 to its second position against spring 363, as shown an arrow indicated at 402. Gate openings 357 and 358 are shifted to communicate with openings 354 and 356 in wall 337, respectively. The electric motor 34 will be energized to rotate the impeller 348 thereby pumping the air from air mattress 319. The continuous operation of motor 344 will evacuate all the air from air mattress 319. When switch 327 is returned to its middle or off position, the power to motor 344 is terminated as well as the power to solenoid 369 and 382. Spring 363 returns the gate 338 to its first position with respect to wall 337. The plunger 383 and valve head 384 are returned to the closed position by spring 386.

While there has been shown and described preferred embodiments of the apparatus for supplying fluid to and venting or withdrawing fluid from one or more fluid receivers, such as air mattresses, it is understood the changes in the pump, air mattresses and valve assemblies can be made by those skilled in the art without departing from the invention. The invention is defined in the following claims.

I claim:

1. An apparatus for selectively supplying air under pressure to first and second air mattresses and selectively regulating the pressure of the air mattresses comprising: casing means having a first internal chamber, a second internal chamber, first opening allowing ambient air to flow into the first chamber, a second opening allowing air to flow from the first chamber to the second chamber, first tubular connector means open to the second chamber, second tubular connector means open to the second chamber, first hose means connecting the first air mattress to the first tubular connector means for carrying air to and from the first air mattress, second hose means connecting the second air mattress to the second connector means for carrying air to and from the second air mattress, a rotatable impeller located in said first chamber operable to move air from the first chamber through the second opening into the second chamber, an electric motor operable to rotate the impeller means, first valve means located in the second chamber operable to close the opening in the first tubular connector means, first solenoid means connected to the first valve means operable to open said first valve means, second valve means operable to open said first valve means, second valve means located in said second chamber operable to close the opening to the second tubular connector means, second solenoid means connected to the said valve means operable to open said second valve means, said first and second solenoid means each having a movable plunger and first and second coils for generating a common magnetic field to move said plunger, a normally closed first switch connected to the first coil, rectifier means connected to first switch and second coil to provide DC power to the first and second coils, second switch means for connecting the rectifier means to the electric motor, first switch, and second coil to energize said first and second coils thereby move the plunger and valve means connected thereto from a closed position to an open position and to energize said electric motor whereby the impeller means moves air into the air mattress connected to the tubular connector associated with the open valve means, said first switch being opened by said plunger when the valve means is in the open position to de-energize the first coil, said plunger and valve means connected thereto being held in the open position by the continued energization of the second coil, said second switch being movable to position for only connecting the rectifier means to the first switch and second coil to energize said first and second coils and the valve means connected to the plunger from a closed position to an open position to allow air to vent from the mattress.

2. The apparatus of claim 1 including: biasing means operable to bias each valve means from an open position to a closed position.

3. The apparatus of claim 1 wherein: each tubular connector means has an annular end surrounding an inlet passage, said first and second valve means each including a member engageable with an annular end to close said inlet passage associated with said annular end.

4. The apparatus of claim 3 including: biasing means surrounding each plunger and engageable with said member to bias said member into engagement with the annular end associated therewith.

5. The apparatus of claim 1 wherein: said electric motor is located in said first chamber, and said impeller is located in general vertical alignment with said second opening whereby on rotation of the impeller by the motor air is pumped through said second opening into the second chamber.

6. An apparatus for selectively supplying air under pressure to first and second air mattresses and selectively regulating the pressure of the air mattresses comprising: casing means having a first internal chamber, a second internal chamber, first opening allowing ambient air to flow into the first chamber, a second opening allowing air to flow from the first chamber to the second chamber, first tubular connector means open to the second chamber, second tubular connector means open to the second chamber, first hose means connecting the first air mattress to the first tubular connector means for carrying air to and from the first air mattress, second hose means connecting the second air mattress to the second connector means for carrying air to and from the second air mattress, a rotatable impeller means located in said first chamber operable to move air from the first chamber through the second opening into the second chamber, an electric motor operable to rotate the impeller means, first valve means located in the second chamber operable to close the opening in the first tubular connector means, first solenoid means connected to the first valve means operable to open said first valve means, second valve means located in said second chamber operable to close the opening to the second tubular connector means, second solenoid means connected to the said second valve means operable to open said second valve means, means providing DC power, a first switch means operable in a first position to connect the means providing D.C. power to the electric motor and first solenoid means whereby the first solenoid mean opens the first valve means and the electric motor rotates the impeller means to supply the air under pressure to the first tubular connector means, first hose means, and the first air mattress and operable in a second position to only connect the means providing DC power to the first solenoid means whereby the first solenoid means opens the first valve means to allow air to vent from the first air mattress, a second switch means operable in a first position to connect the means providing DC power to the electric motor and second solenoid means whereby the second solenoid means opens the second valve means and the electric motor rotates the impeller means to supply air under pressure to the second tubular connector means and second hose means to supply air to the second air mattress and operable in a second position to only connect the means providing DC power to the second solenoid means whereby the second solenoid means opens the second valve means to allow air to vent from the second air mattress.

7. The apparatus of claim 6 including: biasing means operable to bias such valve means form an open position to a closed position.

8. The apparatus of claim 6 wherein: said electric motor is located in said first chamber, and said impeller means is located in general vertical alignment with said second opening whereby on rotation of the impeller means by the electric motor air is pumped through said second opening into the second chamber.

9. An apparatus for selectively supplying air under pressure to first and second air mattresses and selectively regulating the pressure of the air mattresses comprising: casing means having internal chamber means, an air inlet including first opening means allowing ambient air to flow into the chamber means, first and second air outlet means open to the chamber means allowing air to flow from the chamber means, first hose means connecting the first air mattress to the first air outlet means for carrying air to and from the first air mattress, second hose means connecting the second air mattress to the second air outlet means for carrying air to and from the first air mattress, second hose means connecting the second air mattress to the second air outlet for carrying air to and from the second air mattress, a rotatable impeller means located in said chamber means operable to move air from the air inlet means to the first and second air outlet means, an electric motor operable to rotate the impeller means, first valve means located in the chamber means operable to close the first air outlet means, first solenoid means connected to the first valve means operable to open said first valve means, second valve means located in said chamber means operable to close the second air outlet means, second solenoid means connected to the said second valve means operable to open said second valve means, means providing DC power, a first switch means operable in a first position to connect the means providing D.C. power to the electric motor and first solenoid means whereby the first solenoid mean opens the first valve means and the electric motor rotates the impeller means to supply air under pressure to the first air outlet means and the first air mattress and operable in a second position to only connect the means providing DC power to the first solenoid means whereby the first solenoid means opens the first valve means to allow air to vent from the first air mattress, a second switch means operable in a first position to connect the means providing DC power to the electric motor and second solenoid means whereby the second solenoid means opens the second valve means and the electric motor rotates the impeller means to supply air under pressure to the second air outlet means and the second air mattress and operable in a second position to only connect the means providing DC power to the second solenoid means whereby the second solenoid means opens the second valve means to allow air to vent from the second air mattress.

10. The apparatus of claim 9 including: biasing means operable to bias each valve means from an open position to a closed position.

11. The apparatus of claim 9 wherein: said means providing DC power is a rectifier means operable to convert AC electric power to DC electric power.

* * * * *